US012402733B2

(12) United States Patent
Mountz

(10) Patent No.: US 12,402,733 B2
(45) Date of Patent: Sep. 2, 2025

(54) SEAT SUPPORT FOR CHILD SWING

(71) Applicant: Wonderland Switzerland AG, Steinhausen (CH)

(72) Inventor: Jonathan K. Mountz, Elverson, PA (US)

(73) Assignee: Wonderland Switzerland AG, Steinhausen (CH)

( * ) Notice: Subject to any disclaimer, the term of this patent is extended or adjusted under 35 U.S.C. 154(b) by 124 days.

(21) Appl. No.: 18/355,735

(22) Filed: Jul. 20, 2023

(65) Prior Publication Data

US 2024/0032709 A1 Feb. 1, 2024

Related U.S. Application Data

(60) Provisional application No. 63/414,217, filed on Oct. 7, 2022, provisional application No. 63/401,091, filed on Aug. 25, 2022, provisional application No. 63/369,802, filed on Jul. 29, 2022.

(51) Int. Cl.
*A47D 13/10* (2006.01)

(52) U.S. Cl.
CPC ..... *A47D 13/107* (2013.01)

(58) Field of Classification Search
CPC ..... A47D 13/10; A47D 13/107
USPC ..... 297/DIG. 11
See application file for complete search history.

(56) References Cited

U.S. PATENT DOCUMENTS

| | | | | | |
|---|---|---|---|---|---|
| 2,266,092 | A * | 12/1941 | Springer | A47C 3/0252 | 248/629 |
| 2,704,111 | A * | 3/1955 | Wunderlich | A47D 13/105 | 297/274 |
| 3,331,632 | A * | 7/1967 | Lerner | A47D 13/107 | 297/302.4 |
| 6,645,080 | B1 * | 11/2003 | Greger | A47D 13/105 | 472/118 |
| 7,578,561 | B2 * | 8/2009 | Canna | A47D 1/004 | 297/484 |
| 7,845,728 | B2 * | 12/2010 | Chen | A47D 9/057 | 297/260.1 |
| 8,419,132 | B2 * | 4/2013 | Jacobs | A47C 3/025 | 297/344.21 |

* cited by examiner

*Primary Examiner* — Milton Nelson, Jr.
(74) *Attorney, Agent, or Firm* — Fay Kaplun & Marcin, LLP

(57) ABSTRACT

A child swing has a base, a column, and a seat. The seat comprises a seat rim and a seat support. The seat rim is connectable to the column to support the seat above a floor. The seat rim defines a seat opening. The seat support comprises a rigid material and is attached to the seat rim such that movement between the seat support and the seat rim is substantially prevented. The seat support defines a recess on one side of the seat opening. The seat support is positioned relative to the seat rim such that when a child is introduced through the seat opening from an opposing side of the seat opening, the seat support supports the child within the recess.

21 Claims, 34 Drawing Sheets

LIFT SOFT GOODS

BUCKLE THE 5-POINT HARNESS TOGETHER

DROP SOFTGOODS BACK DOWN

SEAT SUPPORT FOR CHILD SWING

PRIORITY CLAIM

The present disclosure claims priority to U.S. Provisional Patent Application Ser. No. 63/369,802 filed Jul. 29, 2022; U.S. Provisional Patent Application Ser. No. 63/401,091 filed Aug. 25, 2022; and U.S. Provisional Patent Application Serial No. 63/414,217 filed Oct. 7, 2022. The disclosure of the above-mentioned applications/patents which are incorporated herewith by reference.

TECHNICAL FIELD

The present disclosure relates generally to child motion apparatuses and, in particular, to child swing apparatuses.

BACKGROUND

Infant swing apparatuses have become common household items. An infant swing has the primary function of applying a gentle motion, such as a swinging, rocking, or gliding motion, to soothe a child, while providing a safe and comfortable seating area. Infant swings are sold in various shapes, sizes, and configurations. A common style of infant swing includes a frame and an infant seat that oscillates relative to the frame. The swing arm moves to impart the motion to the infant seat.

The foregoing background discussion is intended solely to aid the reader. It is not intended to limit the innovations described herein. Thus, the foregoing discussion should not be taken to indicate that any particular element of a prior system is unsuitable for use with the innovations described herein, nor is it intended to indicate that any element is essential in implementing the innovations described herein.

SUMMARY

The present application discloses a child swing that comprises a base, a column, and a seat. The base is configured to support the child swing on a floor. The column extends upwards from the base and defines an axis of rotation. The seat is supported by the column above the base. The seat includes a seat rim and a seat support fixedly attached to the seat rim. The seat support is an integral part of the seat to provide additional support for a child positioned on the swing.

An aspect of the present disclosure provides a seat for a child swing. The child swing includes a base and a column extending from the base. The base is positionable on a floor. The seat comprises a seat rim and a seat support. The seat rim is connectable to the column to support the seat above the floor. The seat rim defines a seat opening. The seat support comprises a rigid material and is attached to the seat rim such that movement between the seat support and the seat rim is substantially prevented. The seat support defines a recess on one side of the seat opening. The seat support is positioned relative to the seat rim such that when a child is introduced through the seat opening from an opposing side of the seat opening, the seat support supports the child within the recess.

This summary is provided to introduce a selection of concepts in a simplified form that are further described below in the Detailed Description section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there are shown in the drawings illustrative embodiments of the disclosure. It should be understood, however, that the application is not limited to the precise arrangements and instrumentalities shown. In the drawings:

FIG. 17 illustrates a top perspective view of a portion of the child swing shown in

FIG. 1;

DETAILED DESCRIPTION

Figure 1:
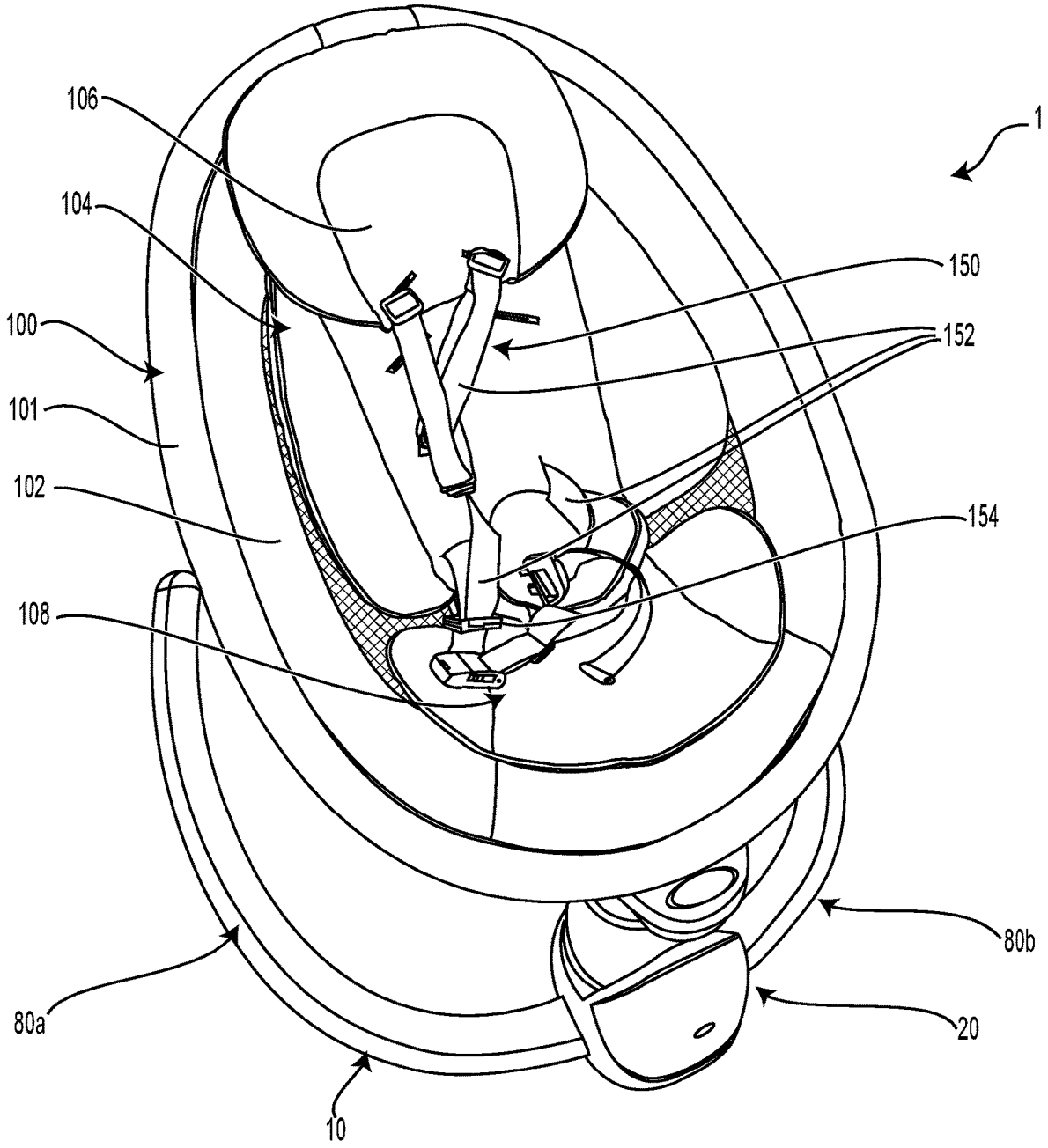
FIG. 1 illustrates a front perspective view of a child swing, according to an aspect of this disclosure.

Certain terminology used in this description is for convenience only and is not limiting. The words "top", "bottom", "upper", "lower", "above", "below", "axial", "transverse", "circumferential," and "radial" designate directions in the drawings to which reference is made. The term "substantially" and derivatives thereof, and words of similar import, when used to describe sizes, shapes, spatial relationships, distances, directions, and other similar parameters includes the stated parameter in addition to a range up to 10% more and up to 10% less than the stated parameter, including 5% more and 5% less, including 3% more and 3% less, including 1% more and 1% less. All ranges disclosed herein are inclusive of the recited endpoint and independently combinable (for example, the range of "from 2 grams to 10 grams" is inclusive of the endpoints, 2 grams and 10 grams, and all the intermediate values). The terminology includes the above-listed words, derivatives thereof and words of similar import.

FIGS. 1-8 show a child swing 1 according to an aspect of this disclosure. FIG. 1 illustrates a front perspective view of the child swing 1. The child swing 1 comprises a base 10, a column 20, and a seat 100. The column 20 is positioned between the base 10 and the seat 100. The base 10 supports the seat 100 above a support surface such as a floor. The seat 100 is configured to move by, for example, swinging, rocking, or gliding relative to the base 10. The column 20 can comprise an extendable column configured to adjust a height of the seat 100 above the support surface. The child swing 1 can further include, for example, a recline mechanism 40 (see FIGS. 2 and 3), a magnetic drive (not shown), a seat motion sensor (not shown), legs 80*a*, 80*b*, a vibration device (not shown), or still other features. However, it will be understood that alternative child swings of this disclosure need not be implemented with all of the recline mechanism 40, the magnetic drive, the seat motion sensor, the legs 80*a*, 80*b* and the vibration device. Rather, alternative child swings of this disclosure can be implemented with fewer than, or include more than, all of the recline mechanism 40, the magnetic drive, the seat motion sensor, the legs 80*a*, 80*b*, and the vibration device. For example, alternative child swings of this disclosure can include one or more, or any combination of two or more, of the recline mechanism 40, the magnetic drive, the seat motion sensor, the legs 80*a*, 80*b*, or the vibration device.

The base 10 is configured to support the child swing 1 on a floor or other surface. The column 20 extends upwards from the base 10 and can define an axis of rotation $A_R$ (See FIG. 3). The seat 100 can be configured to rotate about the axis of rotation $A_R$ relative to the base 10. The seat 100 is supported by the column 20 above the base 10. For example, the column 20 can be attached to the seat 100 such that the seat 100 is disposed on top of the column 20. The column 20 can be configured to transition the seat 100 between a plurality of height positions. For example, the column 20 is configured to transition the seat 100 between a lowered position in which the seat 100 is positioned at a first height above the floor, and a raised position in which the seat 100 is positioned at a second height above the floor greater than the first height.

The seat 100 comprises a seat rim 101 and a seating surface 102 that is configured to support a child thereon. The seating surface 102 can be a soft seating surface formed from soft goods that are suspended from the seat rim 101. In some examples, the seat rim 101 can define a receiving channel 109 that extends around an inner perimeter of the seat rim 101. The receiving channel 109 can be configured to receive an outer edge of the soft goods such that the seat rim 101 remains exposed (i.e., not covered by the soft goods) when the soft goods is attached to the seat rim 101. The seating surface 102 can also include additional soft goods attached to the seating surface 102. For example, the seating surface 102 can include a seating insert 104 positioned on top of the seating surface 102. The seating insert 104 can comprise a seatback 106 and a seat pan 108 formed from soft goods. The seating insert 104 can provide additional support and padding for a child.

In an alternative aspect, the seating surface 102 can be a rigid seating surface formed from a rigid material, such as a polymer and/or a plastic, that defines the seat rim 101. The rigid seating surface can be covered in soft goods to provide cushioning for the child.

Figure 2:
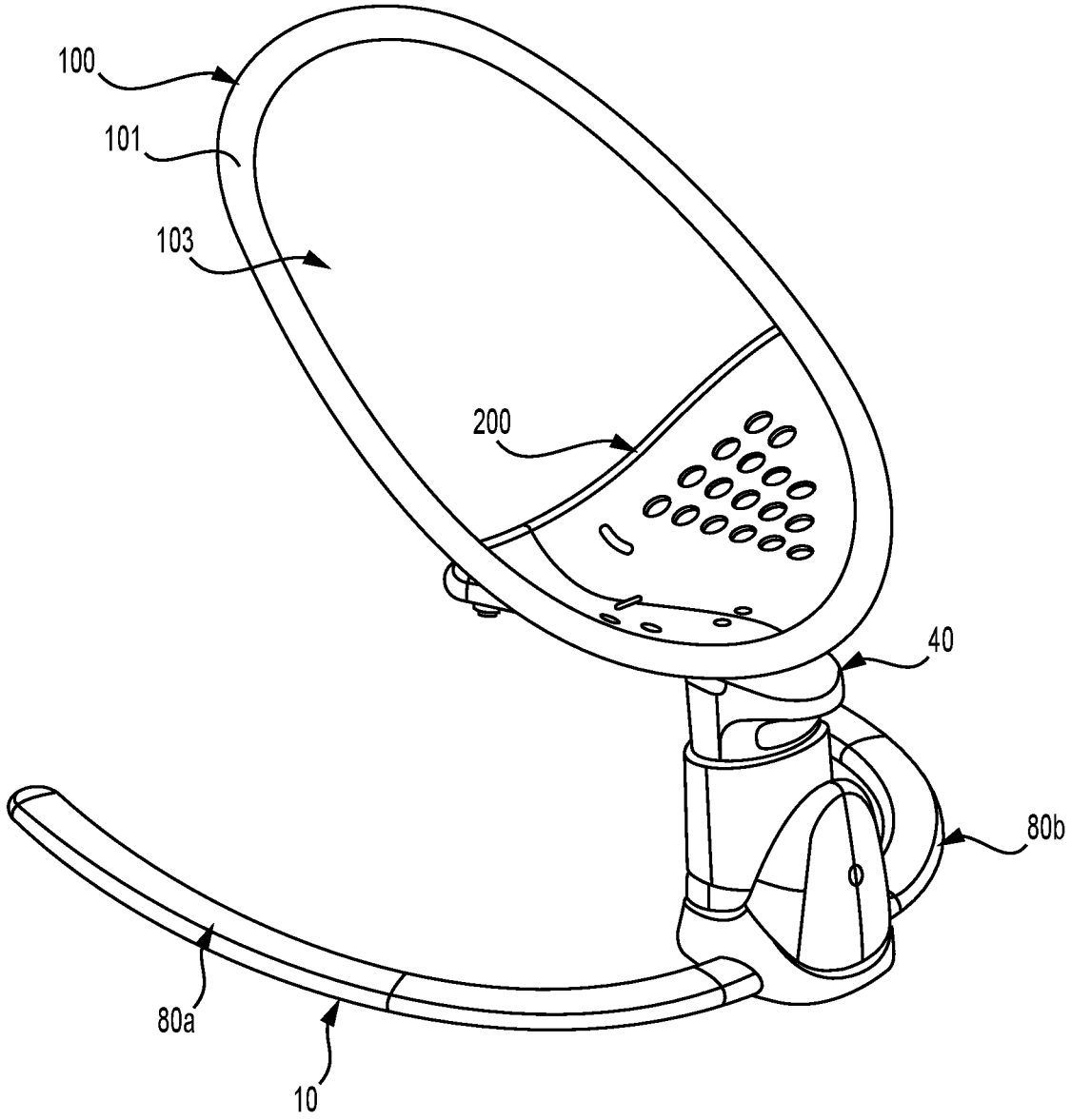
FIG. 2 illustrates a front perspective view of the child swing shown in FIG. 1 without a seating surface, according to an aspect of this disclosure.
Figure 3:
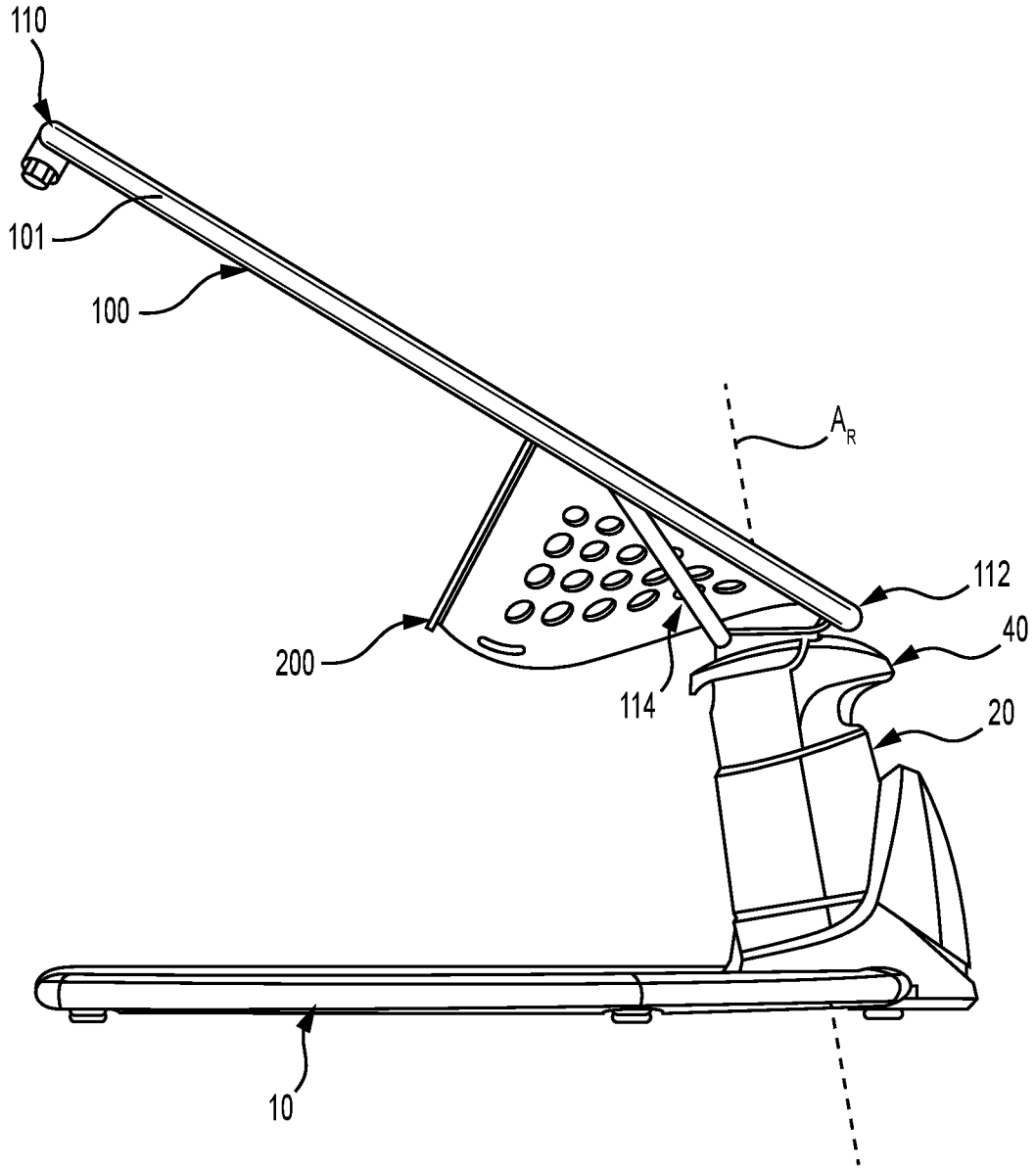
FIG. 3 illustrates a side view of the child swing shown in FIG. 2.
Figure 4:
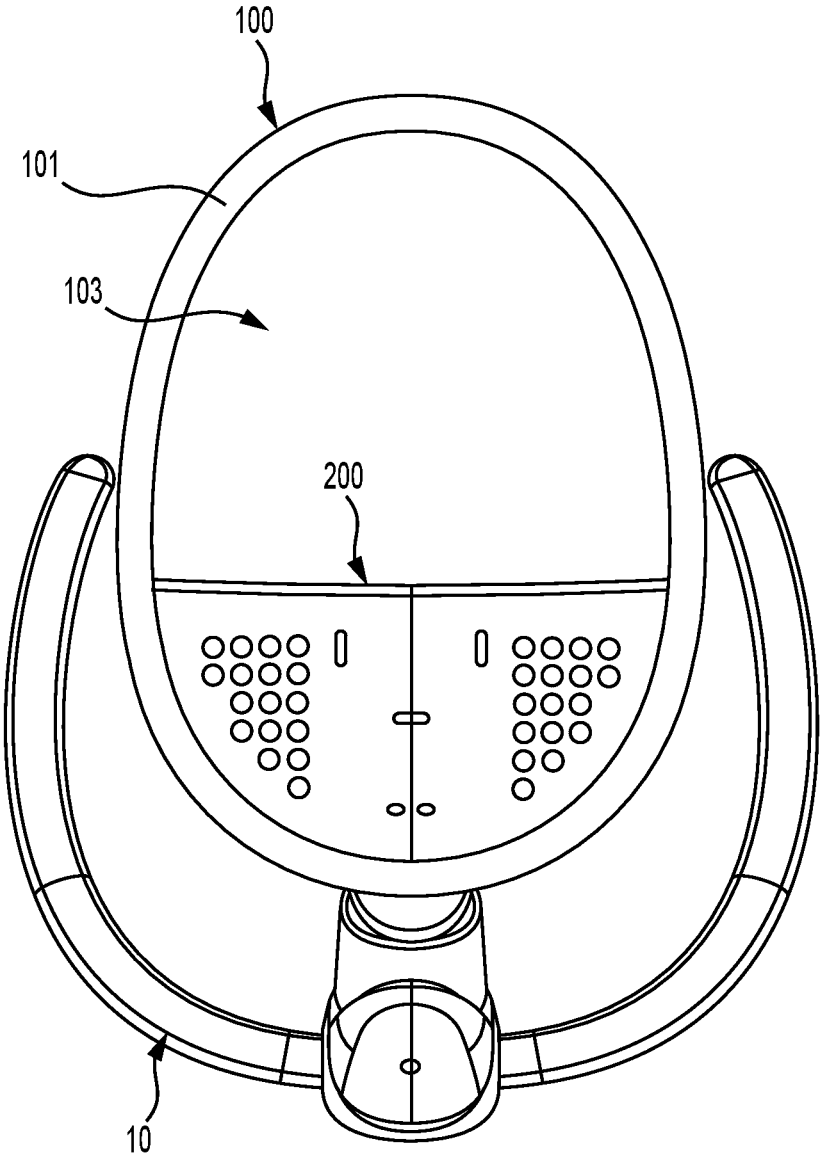
FIG. 4 illustrates a top side view of the child swing shown in FIG. 2.

FIGS. 2-4 illustrate the child swing 1 without the seating surface 102 attached to the seat rim 101 according to an aspect of this disclosure. FIG. 2 illustrates a front perspective view of the child swing 1; FIG. 3 illustrates a side view of the child swing 1; FIG. 4 illustrates a top side view of the child swing 1. The seat rim 101 has an upper end 110 and an opposing lower end 112, as shown in FIG. 3. The seat rim 101 can have a ring shape or another suitable shape that extends between the upper and lower ends 110 and 112. The seat rim 101 can be defined by a tubular ring or other suitable structure. The tubular ring can comprise a metal or other suitably rigid material. The seat rim 101 defines a seat opening 103 that extends along a seat rim plane, as shown in FIGS. 2 and 4. The seat rim plane can be angularly offset from the axis of rotation $A_R$. The axis of rotation $A_R$ can extend through the seat rim plane.

The seat 100 further includes a support member 114 and a seat support 200, as shown in FIG. 3. The support member 114 is configured to support the seat rim 101 on the column when the seat 100 is attached to the column 20. For example, the seat 100 can be cantilevered from the column 20. The seat rim 101 can be attached to the column 20 at the lower end 112 of the seat rim 101. The support member 114 can be attached between the seat rim 101 and the column 20. The support member 114 can extend from a location on the seat rim 101 between the upper end 110 and the lower end 112 to the column 20.

It will be appreciated that in alternative examples, the seat 100 can be attached to the column 20 at another location on the seat rim 101, such as a middle portion or the upper end 110 of the seat rim 101. Similarly, the support member 114 can be attached between the seat rim 101 and the column 20 at various locations to support the seat 100 on the column 20.

The recline mechanism 40 can be positioned between the seat 100 and the column as shown in FIGS. 2-3. For example, the recline mechanism 40 can couple the seat 100 to the column 20. The recline mechanism 40 can be attached to an upper end of the column 20, and the seat rim 101 can be attached to the recline mechanism 40. The support member 114 can extend from the seat rim 101 and be attached to the recline mechanism 40. The recline mechanism 40 is configured to selectively transition the seat 100 between the plurality of recline positions. In an aspect, the seat 100 and the recline mechanism are rotatable about the axis of rotation $A_R$ relative to the base 10.

The seat 100 can be configured to removably couple to the column 20. The seat 100 can be configured to couple to the column 20 such that the seat 100 is rotationally fixed relative to the column 20, such that rotation of the column 20 causes a corresponding rotation of the seat 100. Similarly, the recline mechanism 40 can be rotationally fixed relative to the column 20 such that rotation of the column 20 causes a corresponding rotation of the recline mechanism 40.

The column 20 can comprise a shaft (not shown), which can be referred to as a pivot shaft, that defines the axis of rotation $A_R$. The axis of rotation $A_R$ can define an angle relative to the floor. The angle can be 90 degrees. However, preferably, the angle is less than 90 degrees, as shown in FIG. 3. Thus, the axis of rotation $A_R$ can extend rearward as it extends upward away from the floor. Angling the axis of rotation $A_R$ in such a manner can cause the seat 100 to sway in a manner that mimics a natural pendulum. It will be appreciated that the column 20 can include one or more shafts that can, for example, (1) define the axis of rotation $A_R$ and (2) extend and retract (e.g., a telescope) to adjust a height of the seat 100.

Figure 5:
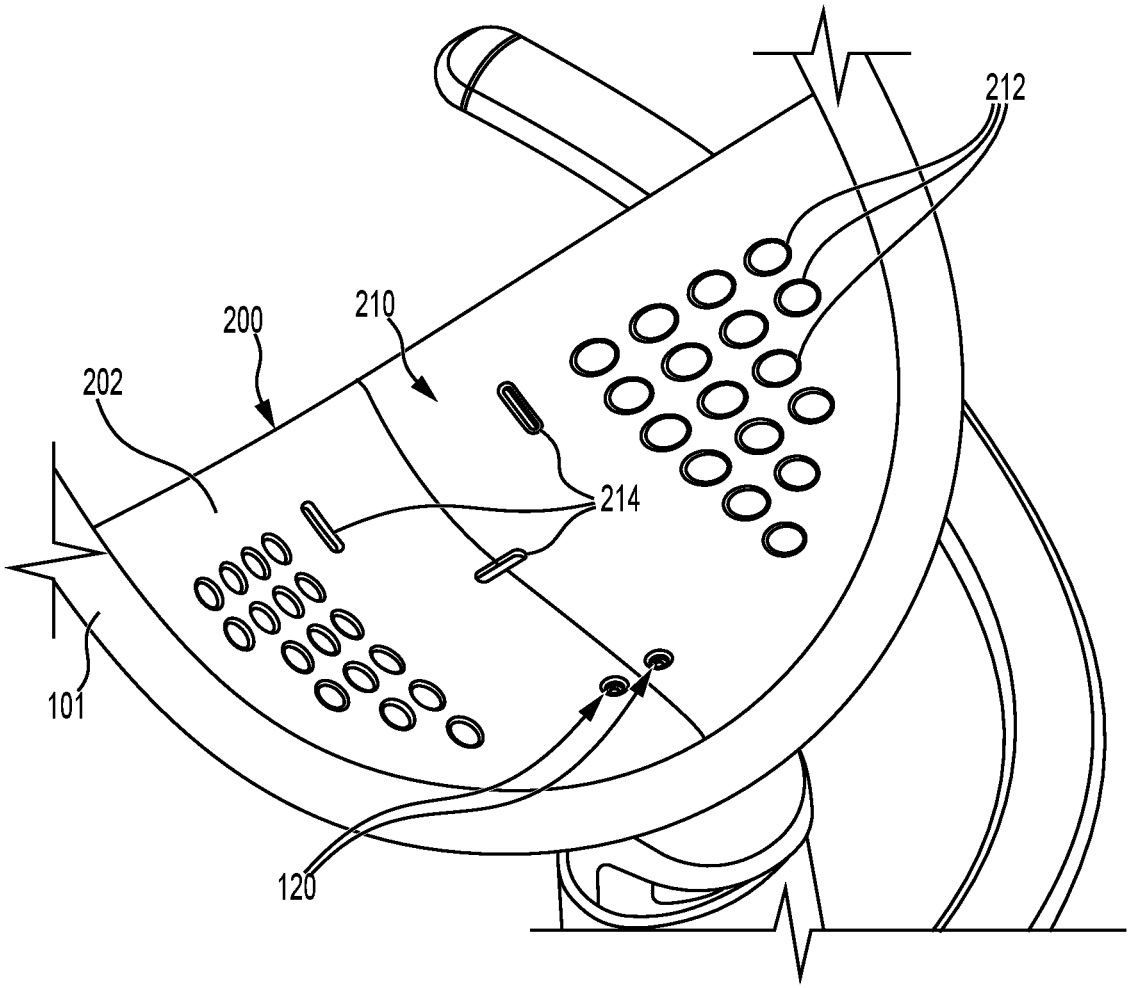
FIG. 5 illustrates a top perspective view of a portion of the child swing shown in FIG. 2.

FIG. 5 illustrates a top perspective view of a portion of the child swing 1 including the seat support 200. The seat support 200 is attached to the seat rim 101. The seat support 200 can be attached to the seat rim 101 via one or more fasteners 120 to create a rigid connection. It will be appreciated that the one or more fasteners can include, for example, screws, bolts, pins, pop rivets, or still other types of fasteners. It will be further appreciated that the seat support 200 can be connected to the seat rim 101 using glue or other adhesives, a snap-fit, a compression fit, combinations thereof, combinations of fasteners, fits, and adhesives, or still other connection types or methods. The seat support 200 is positioned relative to the seat rim 101 such that when a child is introduced through the seat opening 103 from above the child swing 1, the seat support 200 supports the child.

Figure 6:
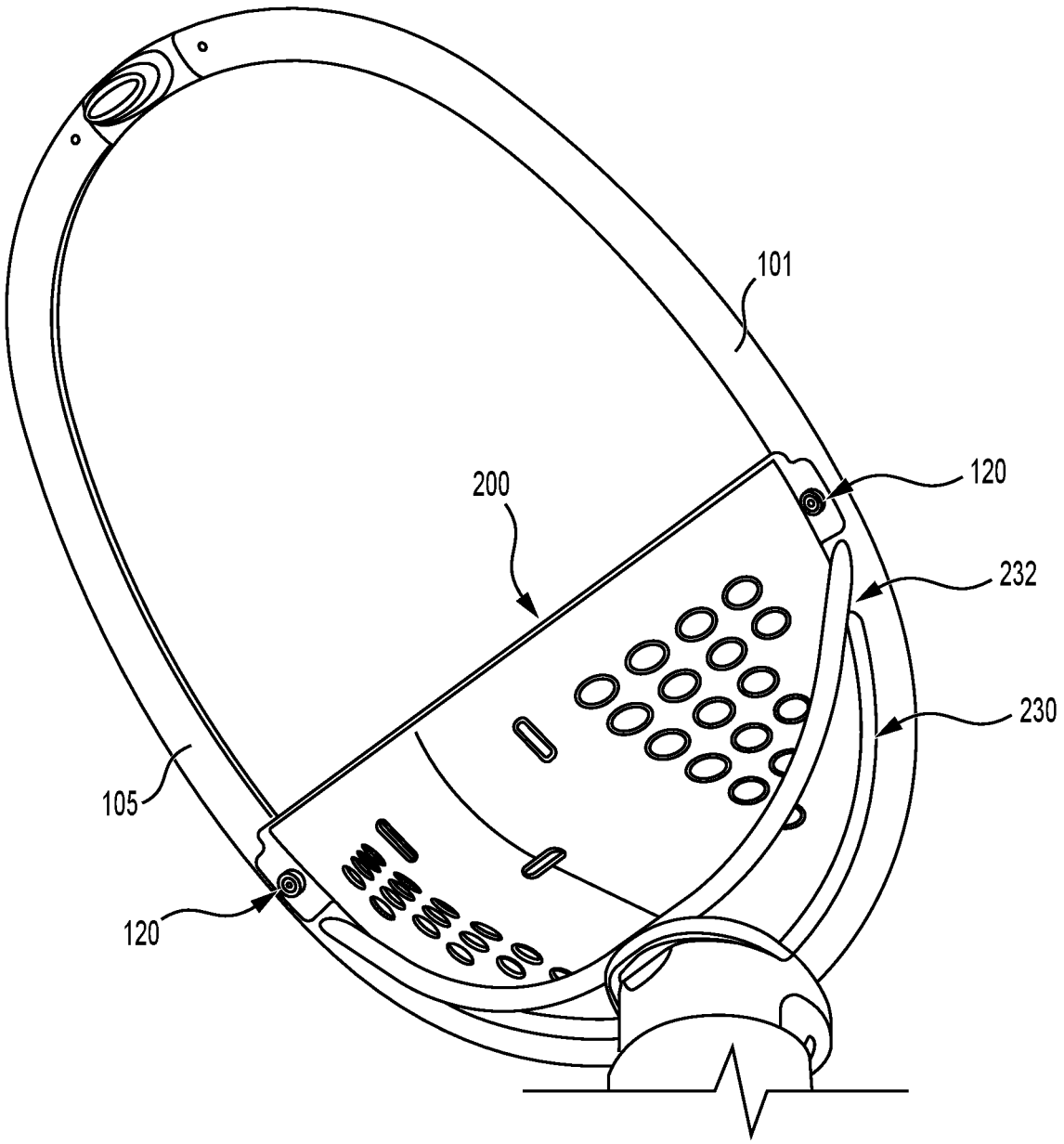
FIG. 6 illustrates a bottom perspective view of a portion of the child swing shown in FIG. 2.
Figure 7:
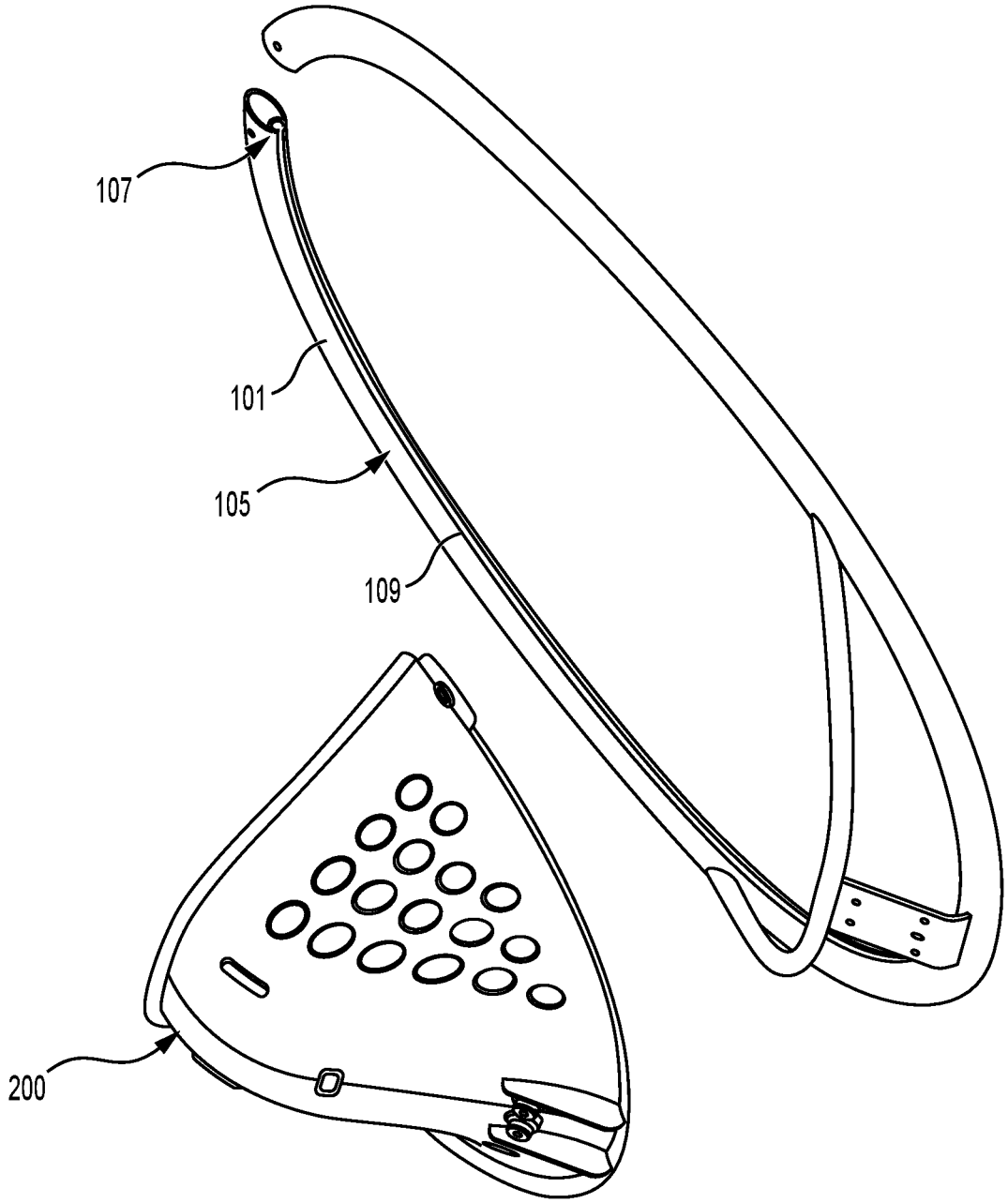
FIG. 7 illustrates an exploded view of a seat of the child swing shown in FIG. 2.
Figure 8:
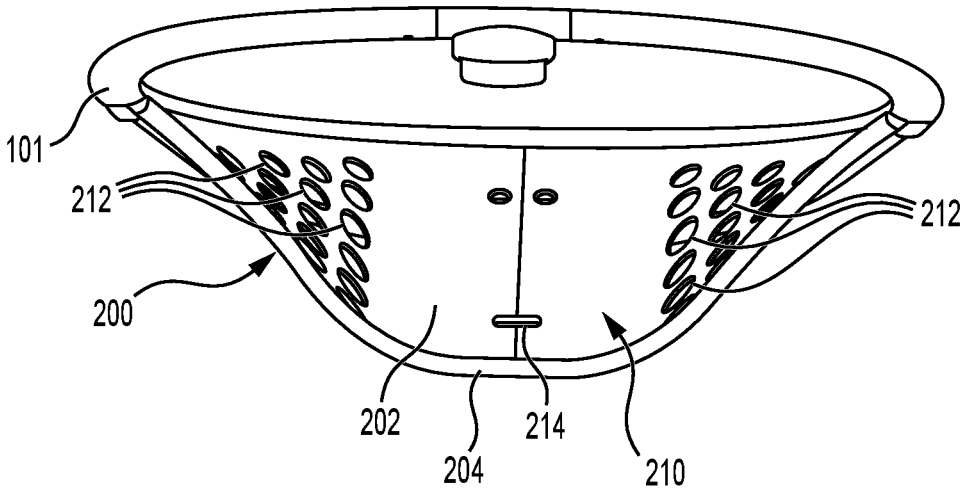
FIG. 8 illustrates a rear side assembled view of the seat shown in FIG. 7.

FIG. 6 illustrates a bottom perspective view of a portion of the child swing 1 including the seat support 200; FIG. 7 illustrates an exploded view of the seat 100 of the child swing 1. FIG. 8 illustrates a rear side assembled view of the seat 100. The seat support 200 can be attached to an underside surface 105 of the seat rim 101. The seat surface 102 can be attached to the seat rim 101 within a groove 107 defined by the seat rim 101, as shown in FIG. 7. The groove 107 can extend about the seat opening 103. In an aspect, the underside surface 105 is positioned between the groove 107 and the seat support 200. The attachment of the seat support 200 to the seat rim 101 allows the seat surface 102 to be attached to the seat rim 101 without interfering with the attachment of the seat support 200.

The seat support 200 can be attached to the seat rim 101 at one location or more than one location on the underside surface 105. The seat support 200 can contact the seat rim 101 along a portion of a length of the seat rim 101 (e.g., a contact portion). The length of the seat rim 101 can extend about the entire seat opening 103. In an aspect, the contact portion is less than half of a length of the seat rim. The contact between the seat support 200 and the seat rim 101 can be continuous along the contact portion. Alternatively, the contact between the seat support 200 and the seat rim 101 along the contact portion can include breaks. For example, the seat support 200 can contact the seat rim 101 at three locations along the contact portion. Each of the three locations can be a location in which a fastener 120 connects the seat support 200 to the seat rim 101. It will be appreciated that the number of breaks along the contact portion can include fewer or more than three breaks.

With reference to FIG. 6, a contact portion 230 between the seat rim 101 and the seat support 200 includes a break 232. The break 232 can be defined by a location along an edge of the seat support 200 that is not in contact with the seat rim 101 and is adjacent to the contact portion 230 between the seat support 200 and the seat rim 101 along the length of the seat rim 101.

The seat support 200 can comprise a rigid material. In an aspect, the rigid material can include a plastic, for example, a polyethylene terephthalate (PET), a high-density polyethylene (HDPE), a polyvinyl chloride (PVC), a low-density polyethylene (LDPE), a polypropylene (PP), a polystyrene (PS), or still other type of plastic. The rigid material of the seat support 200 and the rigid attachment between the seat support 200 and the seat rim 101 substantially prevents movement between the seat support 200 and the seat rim 101. For example, the seat support 200 and seat rim 101 combination can be integrally formed together to form a single substantially rigid part. The integrally formed seat support 200 and seat rim 101 combination provides additional support to the seat 100 so that both the seating surface 102 and the seat support 200 support a child seated on the seat 100. In an aspect, the seat rim 101 comprises a metal and the seat support comprises a plastic.

With reference to FIG. 4, the angle of the top view of FIG. 4 is in a direction that is substantially perpendicular to the seat rim plane. The seat support 200 can be sized such that when the seat 100 is viewed in the direction substantially perpendicular to the seat rim plane (view in FIG. 4), an area of the seat support 200 is less than 50% of an area of the seat opening 103. Stated another way, when the seat 100 is viewed from the direction substantially perpendicular to the seat rim plane, the seat support 200 would be visible in less than 50% of the seat opening 103 area. In an alternative aspect, seat support 200 can be sized such that when the seat 100 is viewed in the direction substantially perpendicular to the seat rim plane, an area of the seat support 200 is less than 40% of an area of the seat opening 103. In another alternative aspect, the seat support 200 can be sized such that when the seat 100 is viewed in the direction substantially perpendicular to the seat rim plane, an area of the seat support 200 is less than 30% of an area of the seat opening 103. The size of the seat support 200 can be selected to, for example, minimize the overall weight of the seat 100 while still providing support to a child positioned on the seat 100.

With reference to FIGS. 5 and 8, the seat support 200 has an inner surface 202 that defines a recess 210. The recess 210 is defined on one side (e.g., a bottom side) of the seat opening 103. The position of the seat support 200 and the recess 210 relative to the seat rim 101 is such that when a child is introduced through the seat opening 103 from an opposing side (e.g., a top side) of the seat opening 103, the seat support 200 supports the child within the recess 210. It will be appreciated that when the seating surface 102 is attached to the seat rim 101, the seating surface 102 can also be supported by the seat support 200, at least partially, when the child is introduced through the seat opening 103 and onto the seating surface 102.

The inner surface 202 of the seat support 200 can define a contoured shape. The contoured shape of the inner surface 202 can be substantially symmetric relative to a plain substantially perpendicular to the seat opening 103 that extends from the upper end 110 to the lower end 112 of the seat rim 101. The contoured shape of the inner surface 202 can help keep the child centered, to provide better balance for swing motion of the seat 100.

The seat support 200 can comprise at least one vent hole 212 and at least one restraint hole 214. The vent hole 212 can extend from the inner surface 202 to an outer surface 204 of the seat support 200, to connect the recess 210 to an exterior of the seat 100. The vent hole(s) 212 can be spaced about the seat support 200. In an aspect, each of the vent holes 212 can have a substantially similar size and shape as each of the other vent holes. The vent holes 212 can allow air access through the seat support 200 when a child is supported thereon to provide a cooling affect.

With reference to FIG. 1, the seat 100 further comprises a child restraint assembly 150. The restraint assembly 150 can include one or more restraint straps 152. The restraint straps 152 can be connected to the seat 100 to retain the child within the seat 100. In particular, the restraint straps 152 can retain the child within the recess 210 of the seat support 200. The restraint assembly 150 can also include one or more buckles 154 for fastening and/or tightening the restraint straps 152 about the child.

With reference again to FIG. 5, the restraint straps 152 can be inserted through the restraint holes 214 defined by the seat support 200. When the seating surface 102 is attached to the seat rim 101, the restraint straps 152 can also be inserted through holes (not labelled) in the seating surface 102. When a child is positioned on the seat support 200, the restraint straps 152 can be fastened around the child to retain the child within the seat 100. The connection of the restraint straps 152 to the seat support 200 can be a fixed connection, such that the connection between the restraint straps 152 and the seat support 200 is substantially prevented from moving due to movement of the child positioned on the seat 100. Alternatively, the connection between the restraint straps 152 and the seat support 200 can allow for movement of the restraint straps 152 within the restraint holes 214. The movement of the restraint straps 152 within the restraint holes 214 can allow for movement of the child within the seat 100 while still retaining the child on the seat support 200.

Figure 16:
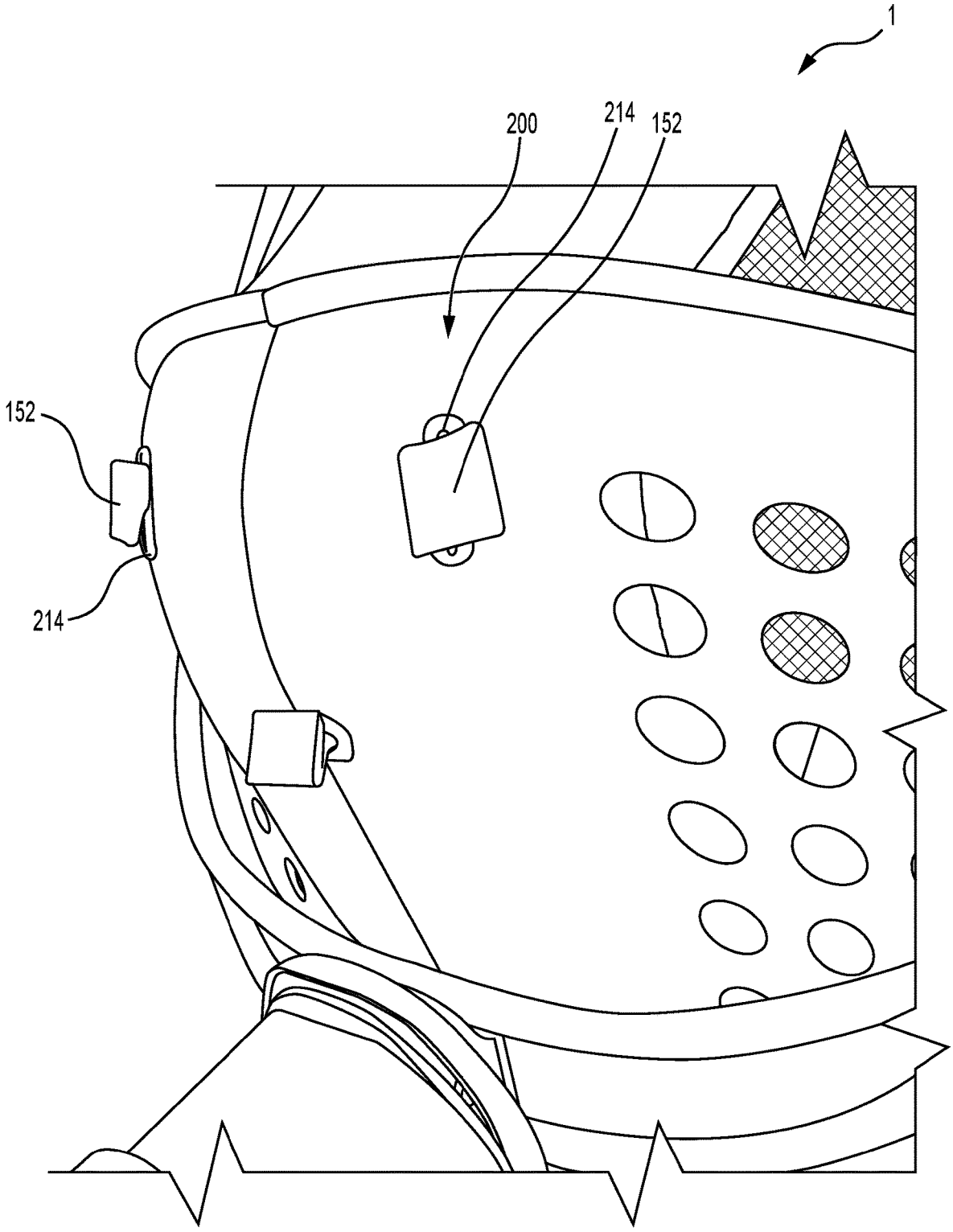
FIG. 16 illustrates a bottom perspective view of a portion of the child swing shown in FIG. 1.
Figure 17:
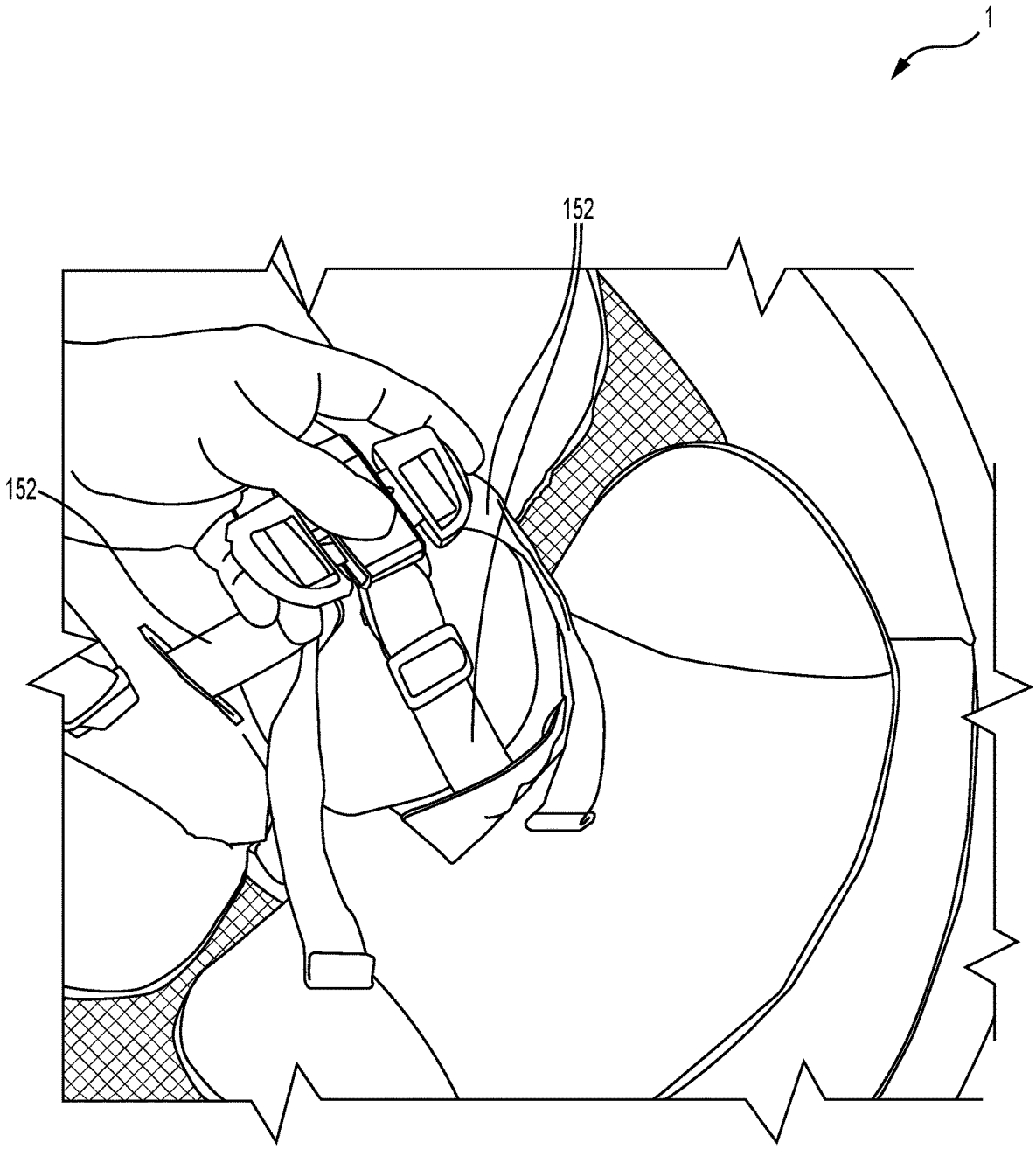
Figure 18:
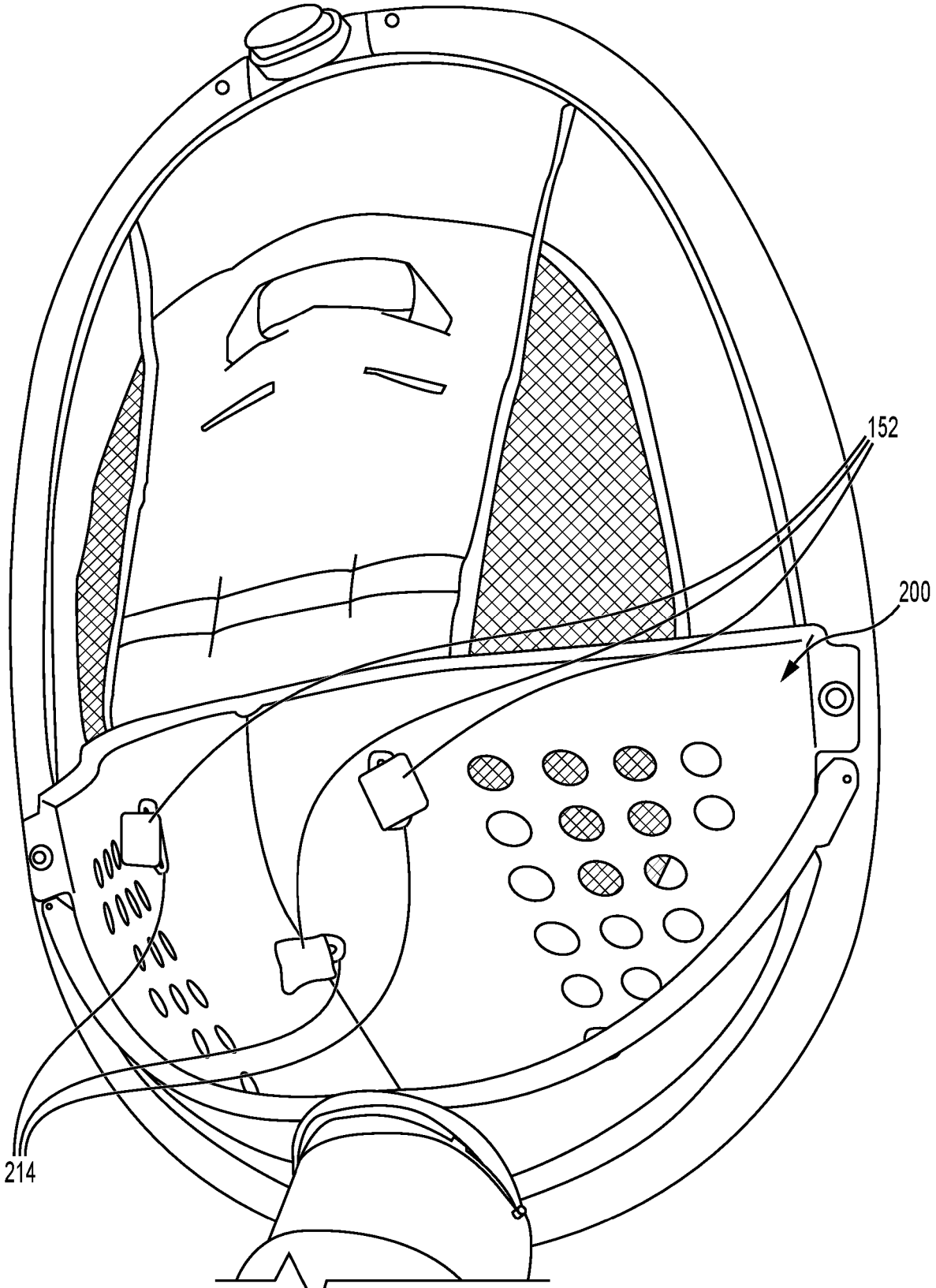
FIG. 18 illustrates a bottom perspective view of a portion of the child swing shown in FIG. 1.

The restraint holes 214 can have a slot or elongate shape. In this regard, the restraint holes 214 can have a shape that corresponds to the shape of the restraint straps 152. The shape of the restraint holes 214 can facilitate insertion and adjustment of the restraint straps 152 with respect to the seat support 200. FIG. 16 illustrates a bottom perspective view of a portion of the child swing 1 including the restraint straps 152 extending through the restraint holes 214; FIG. 17 illustrates a top perspective view of a portion of the child swing 1 including the restraint straps 152; FIG. 18 illustrates a bottom perspective view of a portion of the child swing 1 including the restraint straps 152 extending through the restraint holes 214. The restaint straps 152 are fixed to the seat support 200 beneath the soft goods via, e.g., butterfly stitches.

Figure 9:
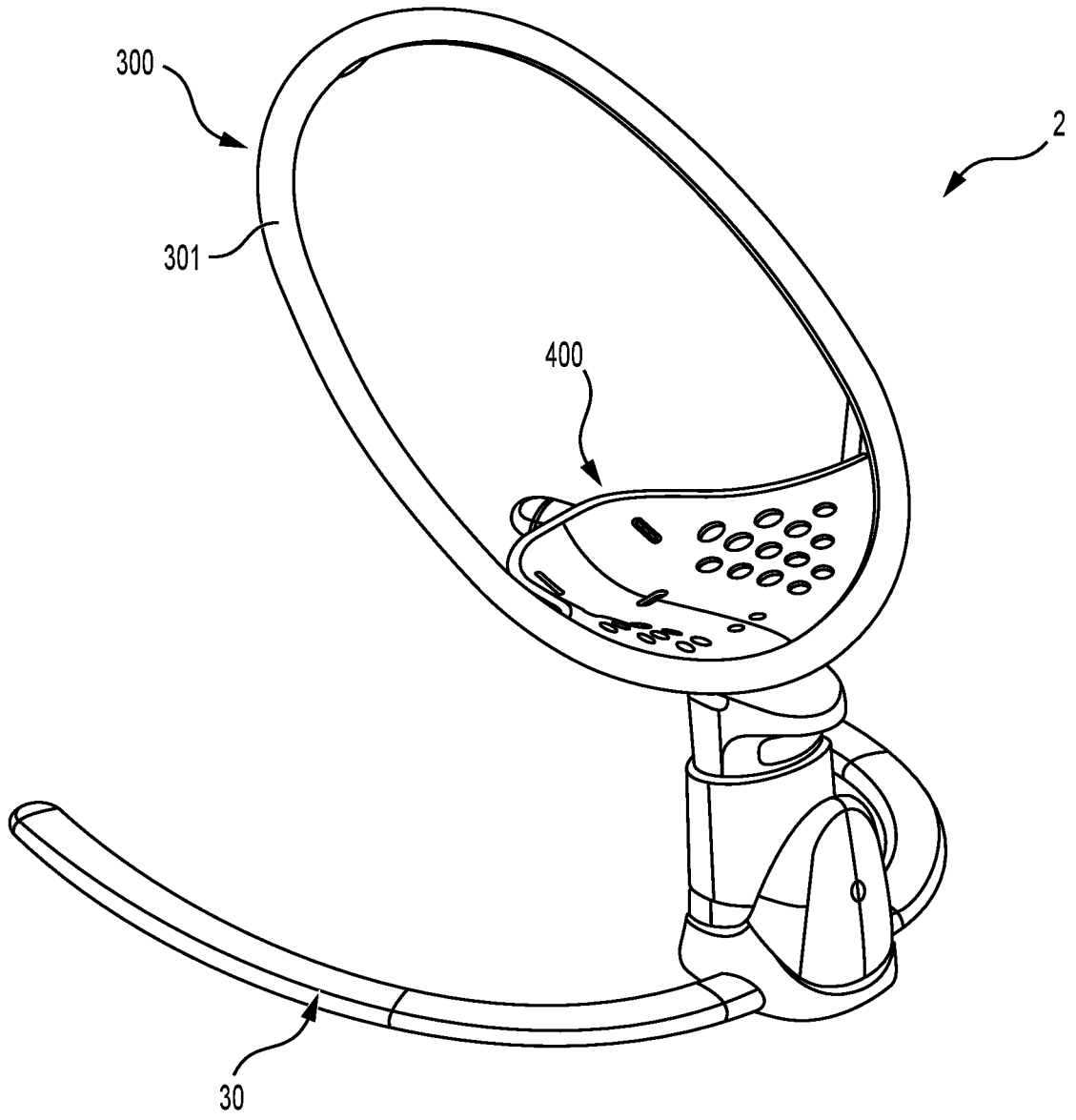
FIG. 9 illustrates a front perspective view of a child swing without a seating surface, according to another aspect of this disclosure.
Figure 10:
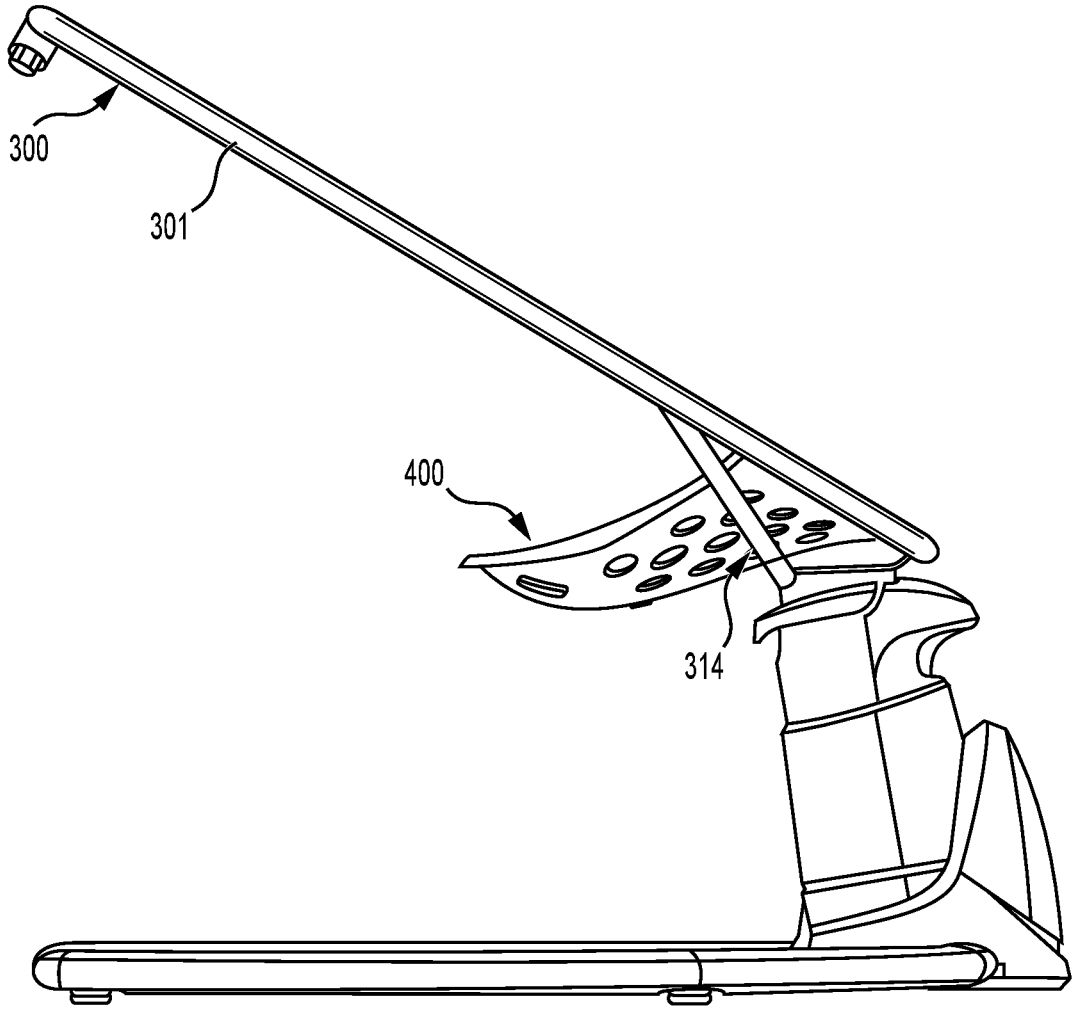
FIG. 10 illustrates a side view of the child swing shown in FIG. 9.
Figure 11:
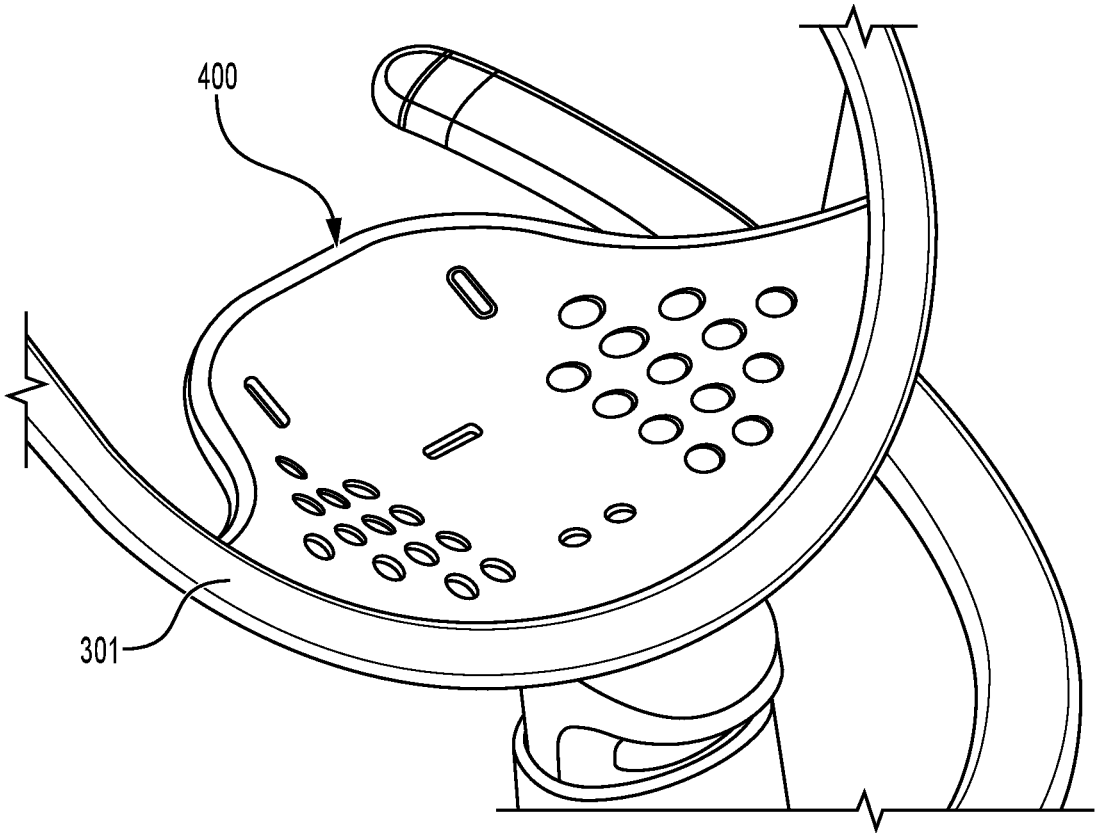
FIG. 11 illustrates a top perspective view of a portion of the child swing shown in FIG. 9.
Figure 12:
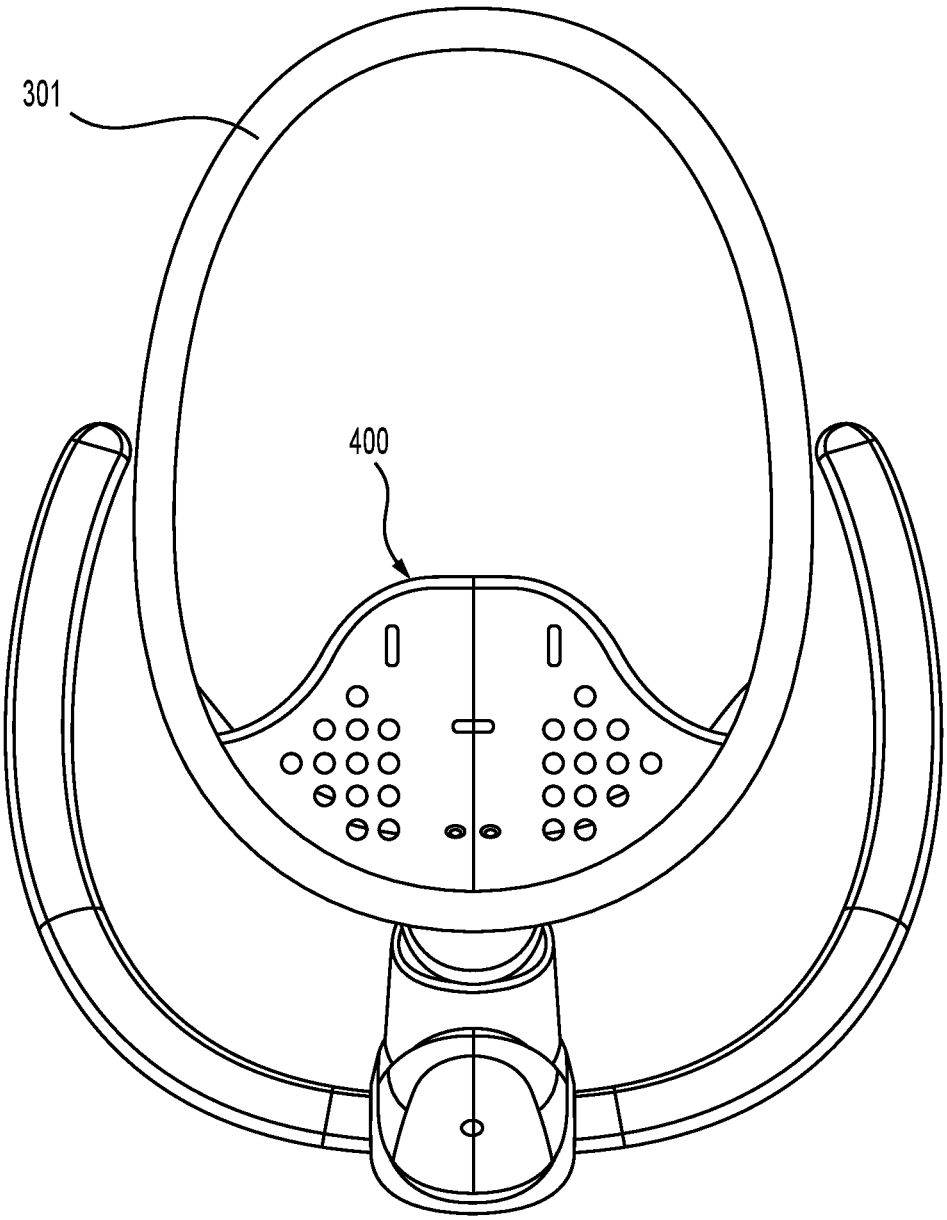
FIG. 12 illustrates a top side view of the child swing shown in FIG. 9.

FIGS. 9-15 illustrate a child swing 2, according to another aspect of this disclosure. Portions of the alternate aspect of the child swing 2 disclosed in FIGS. 9-15 are similar to aspects of the child swing 1 described above in FIGS. 1-8 and those portions function similarly to those described above. The child swing 2 comprises a seat 300. FIGS. 9-15 illustrate the child swing 2 without the seating surface 102 coupled to the seat 300. The seat 300 is configured to support a child on the child swing 2. FIG. 9 illustrates a front perspective view of the child swing 2; FIG. 10 illustrates a side view of the child swing 2; FIG. 11 illustrates a top perspective view of a portion of the child swing 2 including a seat support 400; FIG. 12 illustrates a top side view of the child swing 2. Portions of the child swing 1 described in FIGS. 1-8 including, e.g., the base 10; the column 20; the recline mechanism 40; and the legs 80*a*, 80*b*, may be included in the child swing 2 described in FIGS. 9-18 in a manner substantially similar to that of the child swing 1.

The seat 300 comprises a seat rim 301, a support member 314, and a seat support 400. The seat support 400 is attached to the seat rim 301. As shown in FIG. 12, the seat support 400 is smaller than the seat support 200 of the child swing 1, as shown in FIG. 4, thereby reducing the amount of material used to manufacture the seat support 400 relative to the seat support 200. The seat support 400 is shaped to accommodate a rear of the child. It will be appreciated that the exemplary embodiments are not limited to the shape and size described for seat supports 200 and 400 and other shapes or sizes of seat supports can be used to accommodate and support a child positioned within respective seats 100 and 300.

Figure 13:
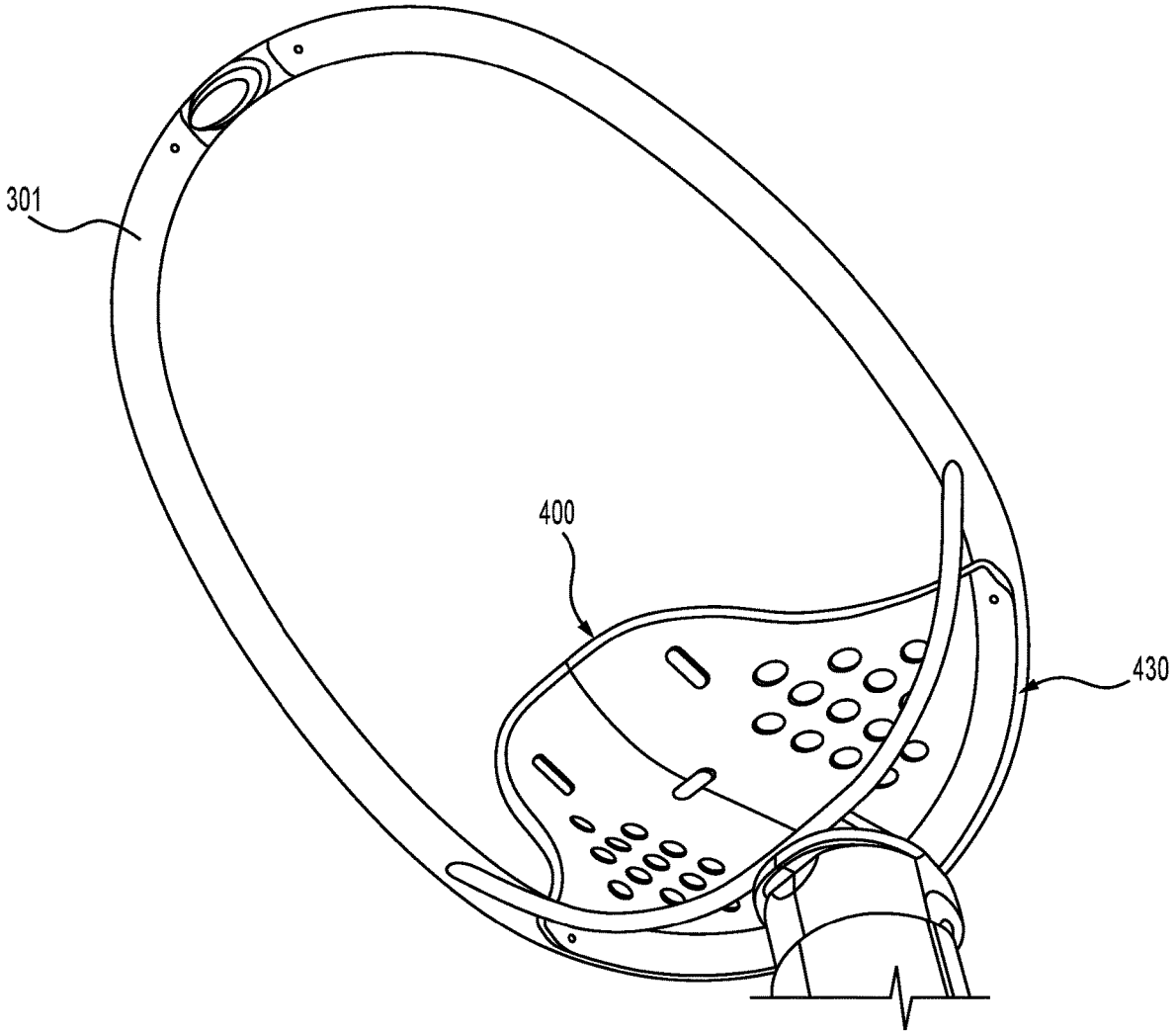
FIG. 13 illustrates a bottom perspective view of a portion of the child swing shown in FIG. 9.
Figure 14A:
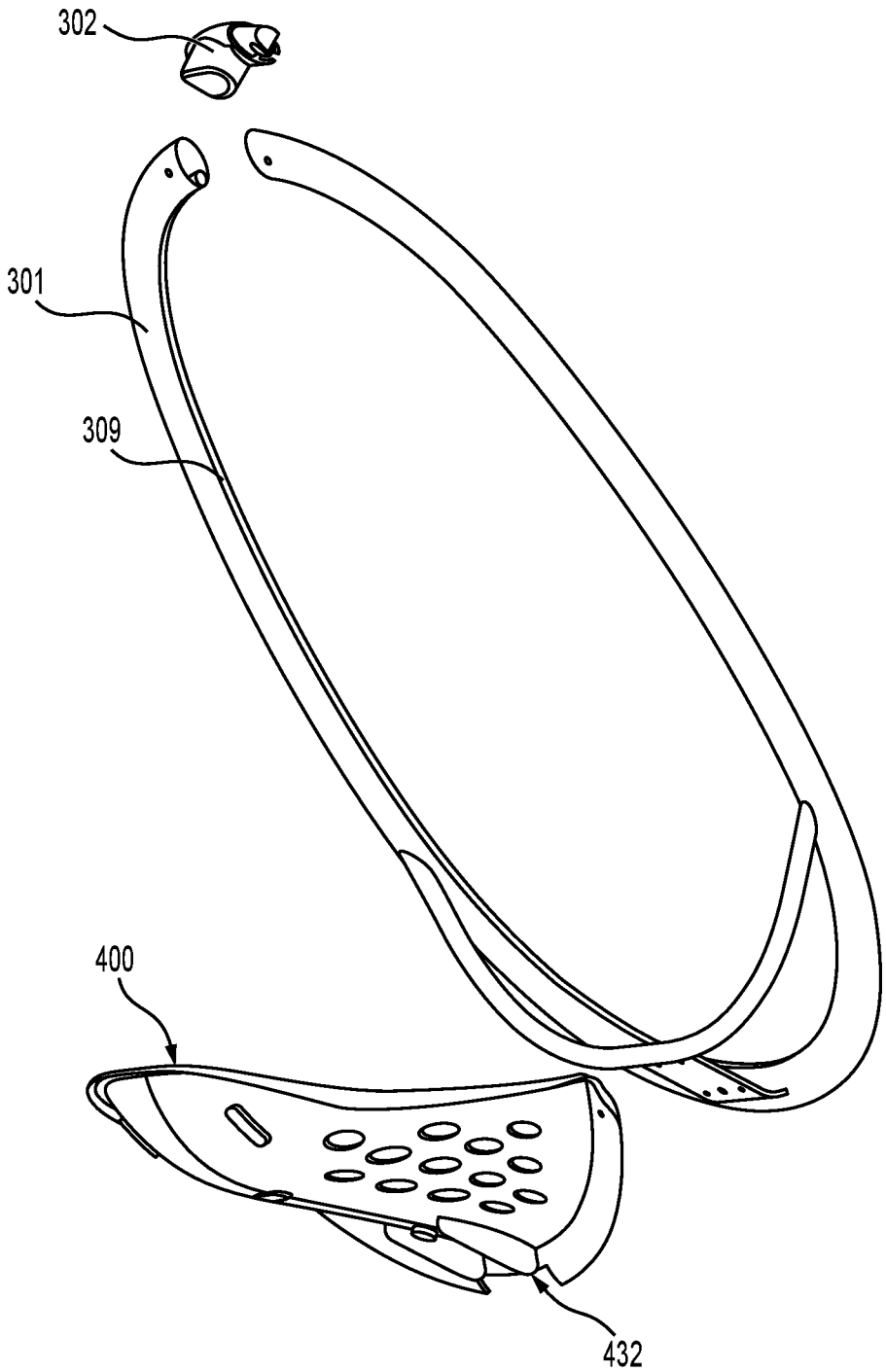
FIG. 14A illustrates an exploded view of a seat of the child swing shown in FIG. 9.
Figure 15:
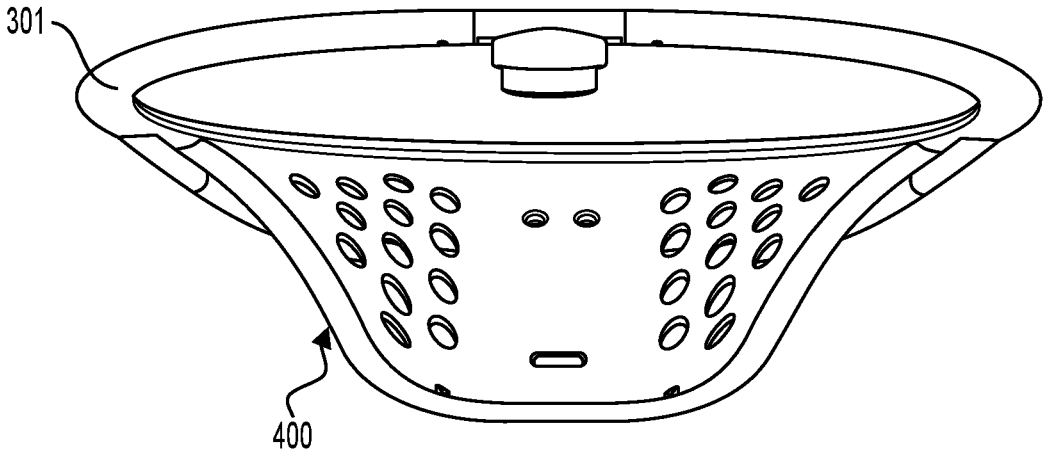
FIG. 15 illustrates a side assembled view of the seat shown in FIG. 14A.

FIG. 13 illustrates a bottom perspective view of a portion of the child swing 2; FIG. 14A illustrates an exploded view of the seat 300 of the child swing 2; FIG. 15 illustrates a side assembled view of the seat 300 of the child swing 2. A contact portion 430 between the seat rim 301 and the seat support 400, as shown in FIG. 13, includes a break 432, as shown in FIG. 14A. The break 232 can be defined by a location along an edge of the seat support 400 that is not in contact with the seat rim 301 and is adjacent to the contact portion 430 between the seat support 400 and the seat rim 301 along the length of the seat rim 301. In the example shown in, e.g., FIG. 14A, the break 432 is located at the lower end of the seat 300.

The seat rim 301 can define a receiving channel 309 that extends around an inner perimeter of the seat rim 301, as shown in FIG. 14A. The receiving channel 309 can be configured to receive an outer edge of the soft goods such that the seat rim 301 remains exposed (i.e., not covered by the soft goods) when the soft goods is attached to the seat rim 301. The soft goods can be attached to the seat rim 301 by inserting a retention member (not shown) into the receiving channel 309 to prevent the portion of the outer edge of the soft goods positioned within the receiving channel 309 from being removed (e.g., from being pulled out of the receiving channel 309).

Figure 14B:
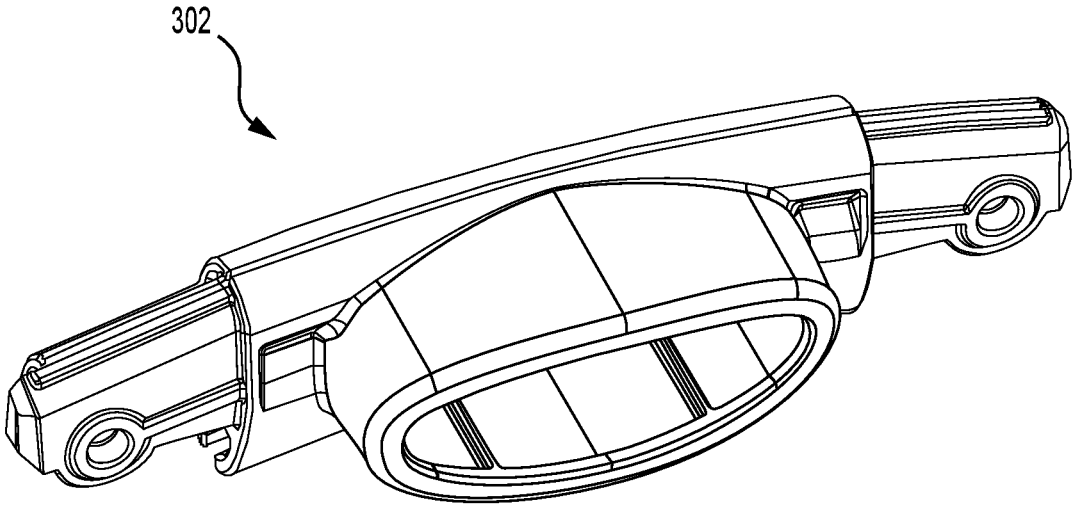
FIG. 14B and 14C illustrate perspective views an actuator connector, according to an aspect of this disclosure.
Figure 14C:
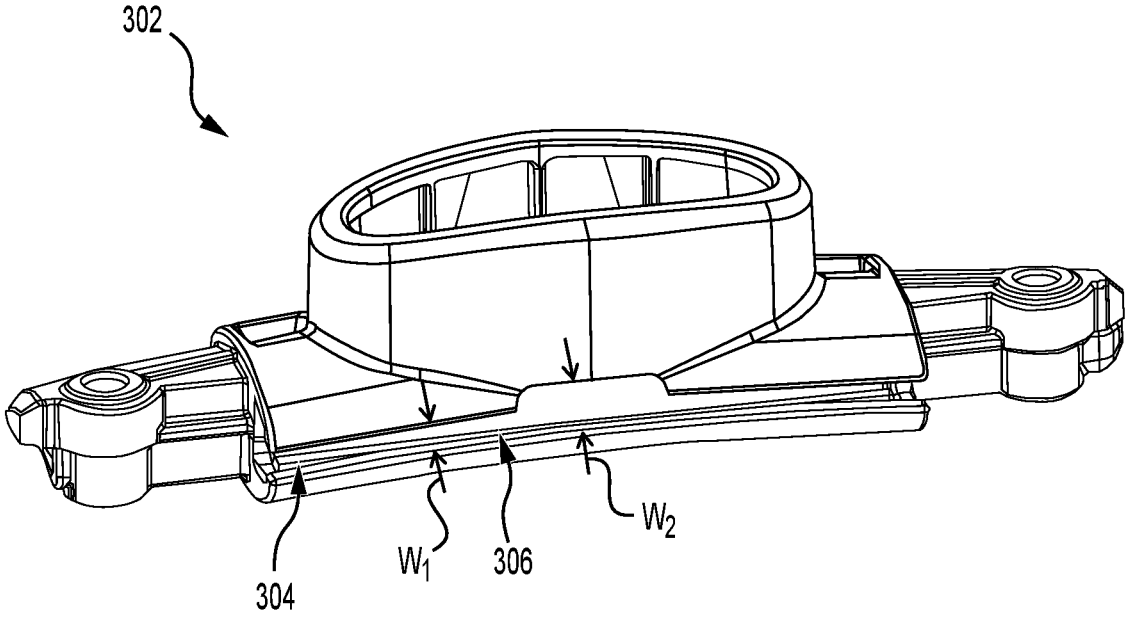

FIG. 14B and 14C illustrate perspective views of an actuator connector 302 of the seat 300 according to an aspect of this disclosure. The seat 300 includes an actuator connector 302 that can be connected to the seat rim 301 to form a perimeter about the seat 300, as shown in FIG. 14A. The actuator connector 302 can be connected to the seat rim 301 via bolts, screws, snap-fit, or other fastening mechanisms.

The actuator connector 302 can comprise an actuator configured to, for example, incline/recline the seat 300 relative to a base 30 of the child swing 2. The actuator connector 302 defines an actuator channel 304 that extends around an inner perimeter of the actuator connector 302. When the actuator connector 302 is connected to the seat rim 301, the actuator channel 304 and the receiving channel 309 align to form a continuous channel extending around the inner perimeter of the seat rim 301 and actuator connector 302.

The actuator channel 304 includes a channel opening 306 that opens to an interior of the seat 300. The channel opening 306 includes a first channel opening that has a first width $w_1$ and a second channel opening that has a second width $w_2$. In an aspect, the second width $w_2$ is greater than the first width $w_1$. The difference in width of the first width w1 and the second width $w_2$ can facilitate the insertion of the retention member into the receiving channel 309 of the seat rim 301 and the actuator channel 304 of the actuator connector 302. For example, a retention member having a cross sectional dimension that is greater than the first width $w_1$ and less than the second width $w_2$ can be inserted into the actuator channel 304 through the portion of the actuator channel 304 having the second width $w_2$. The retention member can then be inserted into the receiving channel 309 of the seat rim 301 from the actuator channel 304. In an aspect, the retention member can be a flexible member, such that the retention member can conform to the shape of the receiving channel 309 after insertion.

Figure 19:
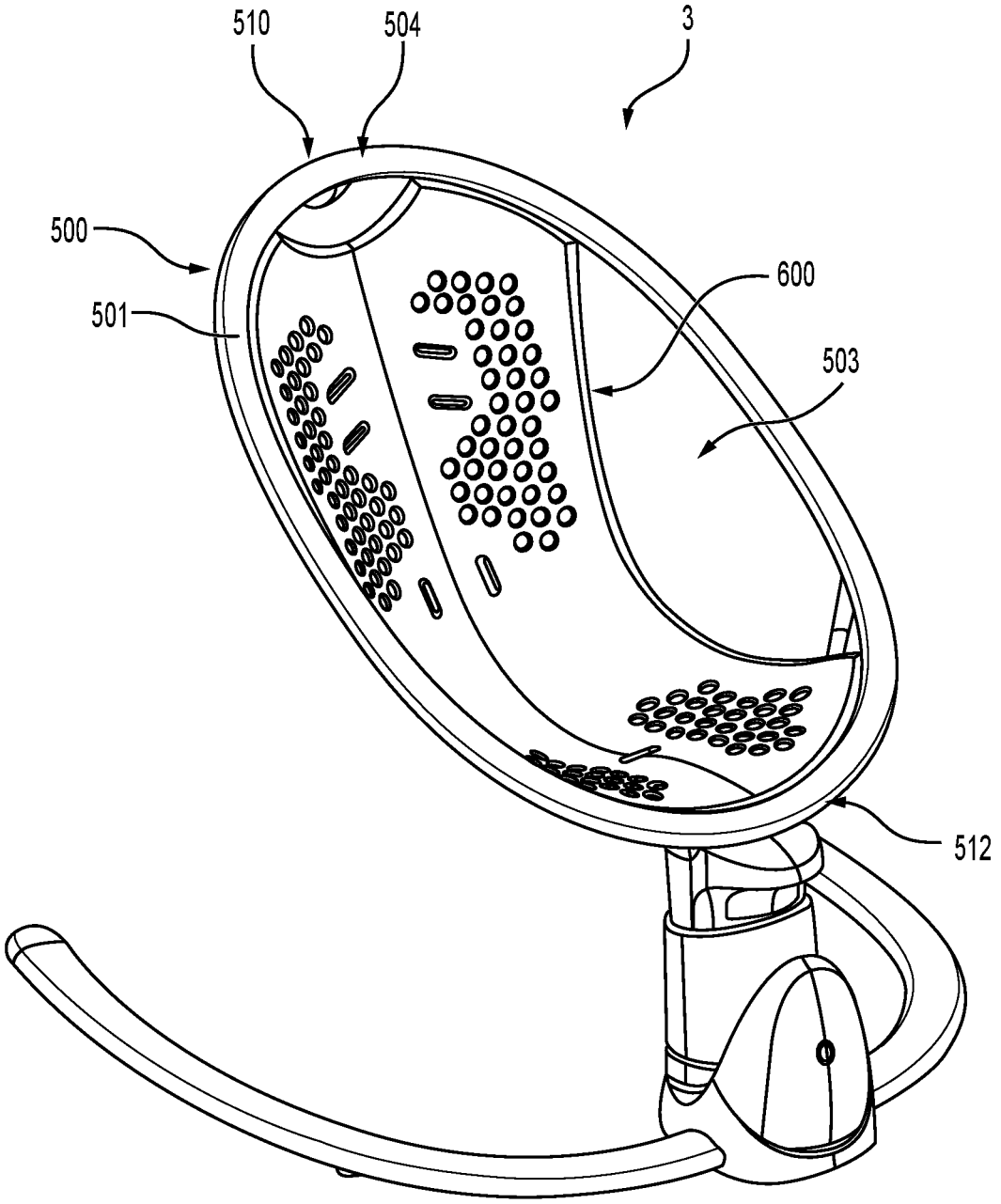
FIG. 19 illustrates a front perspective view of a child swing according to another aspect of this disclosure.
Figure 20:
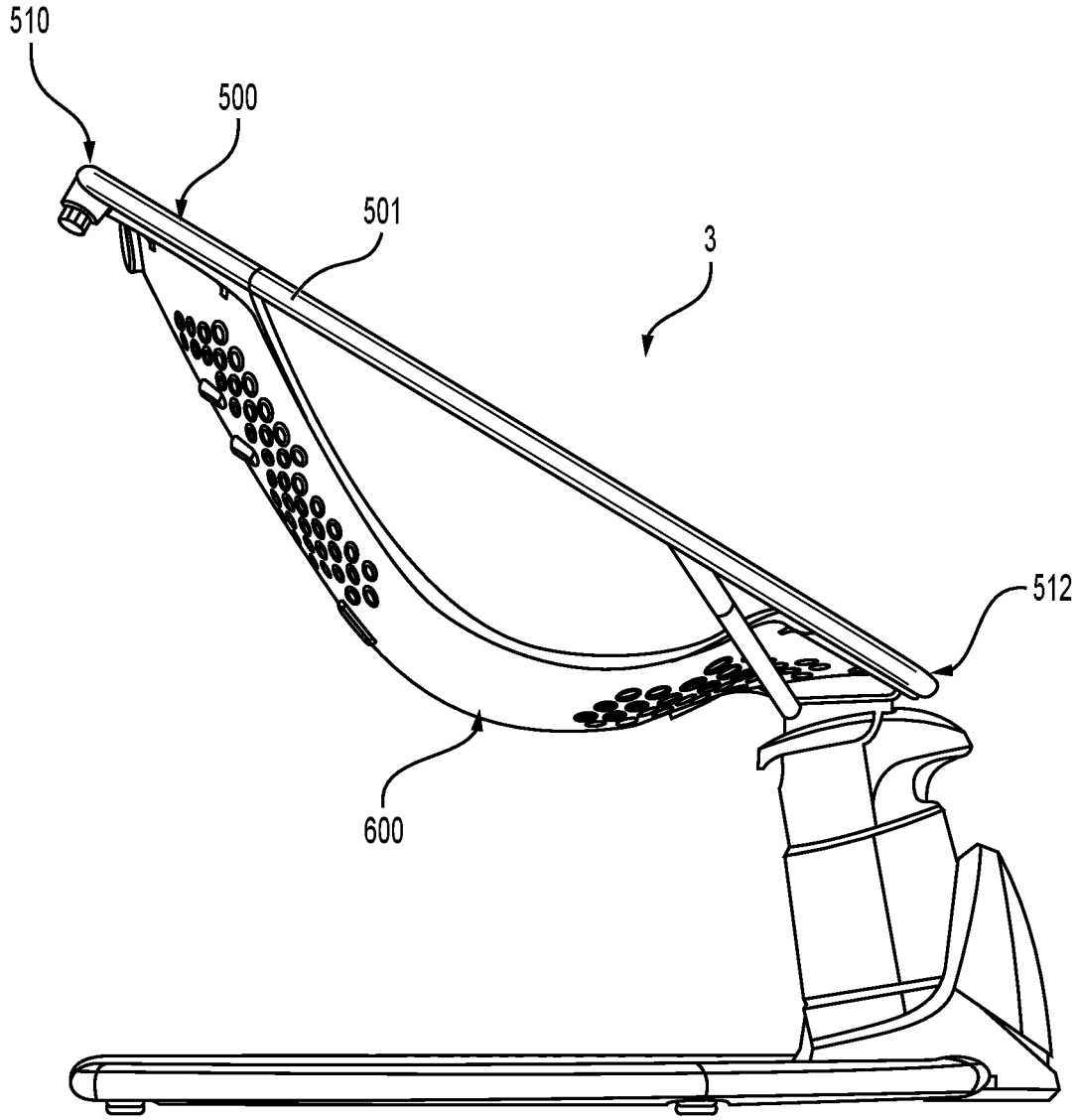
FIG. 20 illustrates a side view of the child swing shown in FIG. 19.
Figure 21:
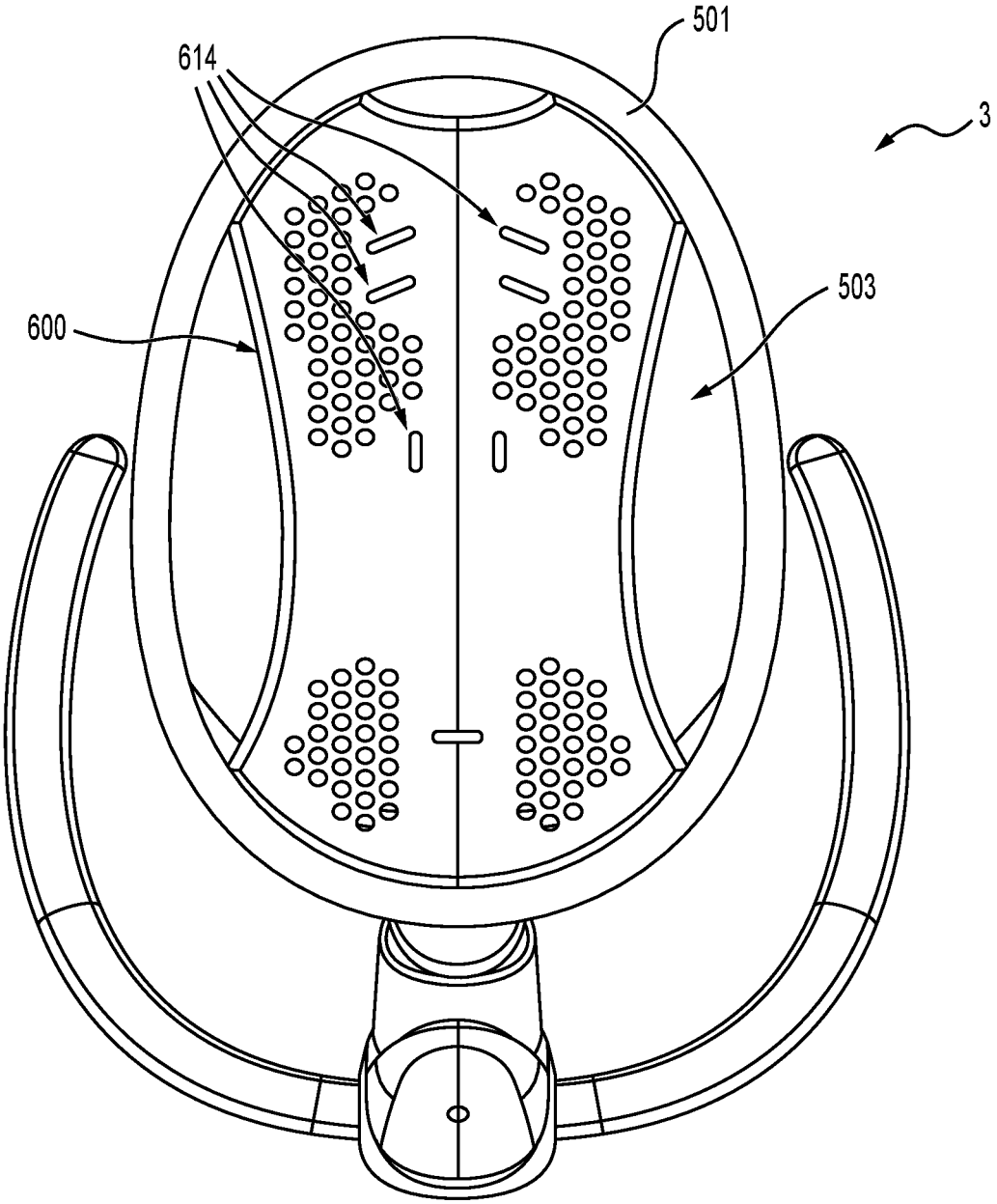
FIG. 21 illustrates a top side view of the child swing shown in FIG. 19.
Figure 22:
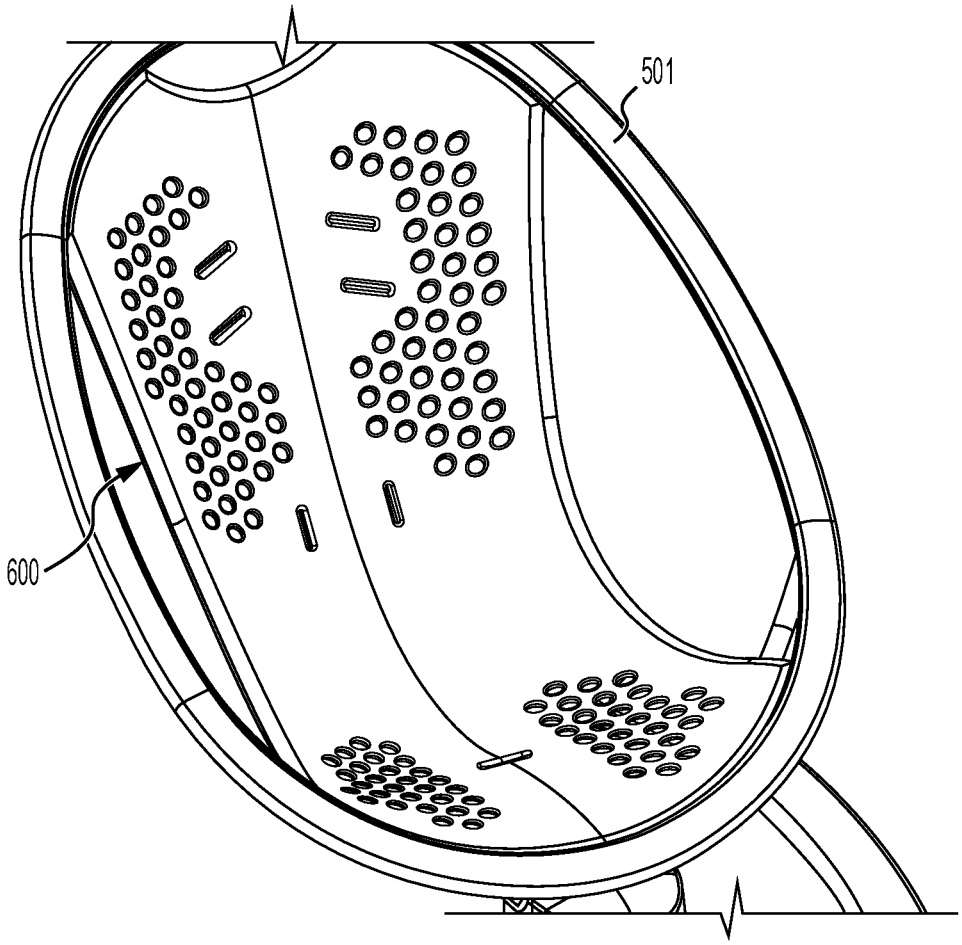
FIG. 22 illustrates a top perspective view of a portion of the child swing shown in FIG. 19.

FIGS. 19-27 illustrate a child swing 3, according to another aspect of this disclosure. Portions of the alternate aspect of the child swing 3 disclosed in FIGS. 19-27 are similar to aspects of the child swings 1 and 2 described above in FIGS. 1-18 and those portions function similarly to those described above. The child swing 3 comprises a seat 500. FIGS. 19-24 illustrate the child swing 3 without a seating surface 502 coupled to the seat 500. The seat 500 is configured to support a child on the child swing 3. FIG. 19 illustrates a front perspective view of the child swing 3; FIG. 20 illustrates a side view of the child swing 3; FIG. 21 illustrates a top side view of the child swing 3; FIG. 22 illustrates a top perspective view of a portion of the child swing 3; FIG. 23B illustrates an actuator connector 504 of the seat 500 of the child swing 3. Portions of the child swing 1 described in FIGS. 1-8 including, e.g., the base 10; the column 20; the recline mechanism 40; the seating surface 102 (e.g., soft goods); and the legs 80*a*, 80*b*, may be included in the child swing 3 described in FIGS. 19-27 in a manner substantially similar to that of the child swing 1.

The seat 500 comprises a seat rim 501 and a seat support 600. The seat support 600 is attached to the seat rim 501. The seat support 600 can be attached to the seat rim 501 toward both an upper end 510 of the seat rim 501 and a lower end 512 of the seat rim 501, such that the seat support 600 extends beneath an opening 503 defined by the seat rim 501. The seat 500 further includes an actuator connector 504 that can be similar to the actuator connector 302 described above with regard to the seat 300 of FIGS. 9-15. The seat support 600 is positioned and shaped to accommodate a rear of the child and also provide back support for the child. It will be appreciated that the seat support 600 can include other shapes or sizes to accommodate and support a child positioned within seat 500.

Figure 23A:
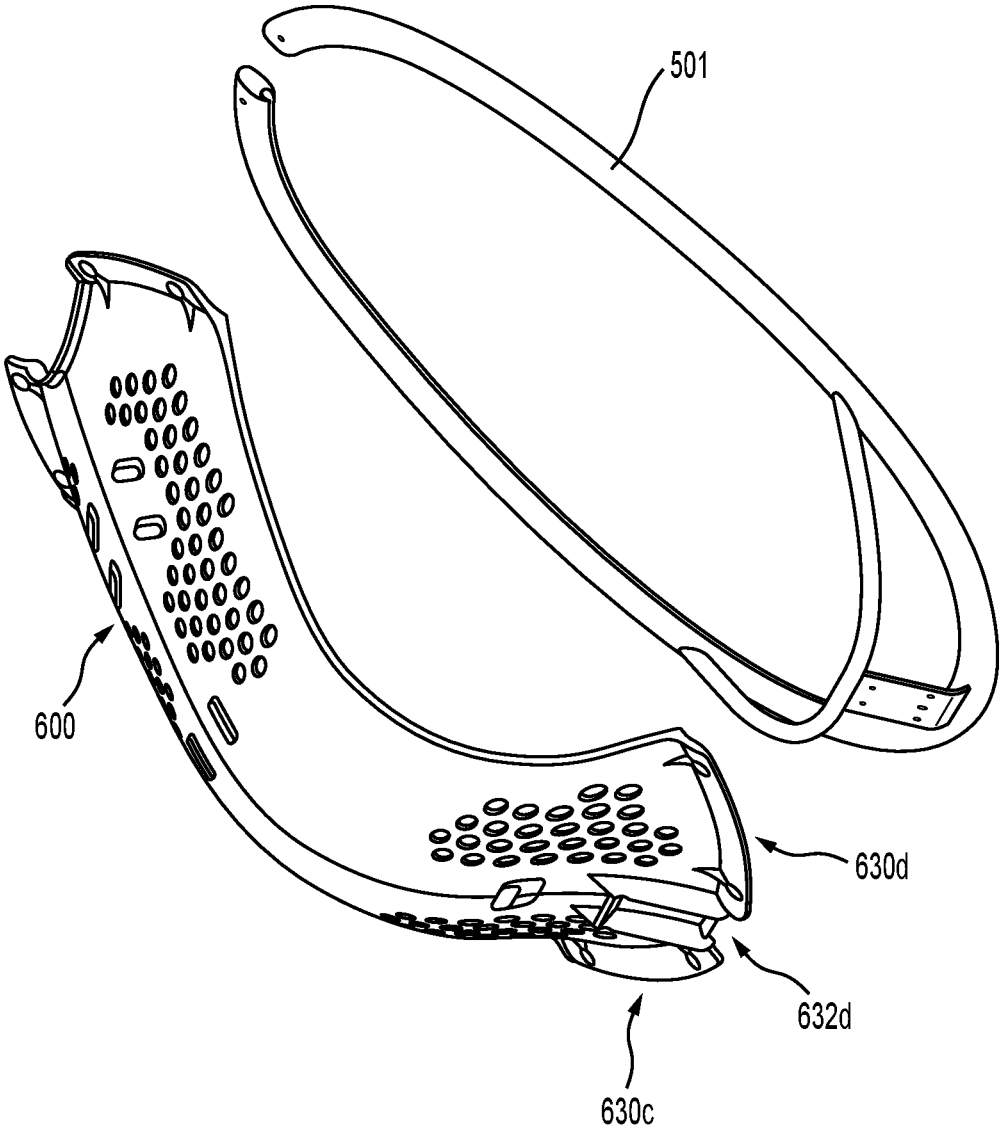
FIG. 23A illustrates an exploded view of a seat of the child swing shown in FIG. 19.
Figure 23B:
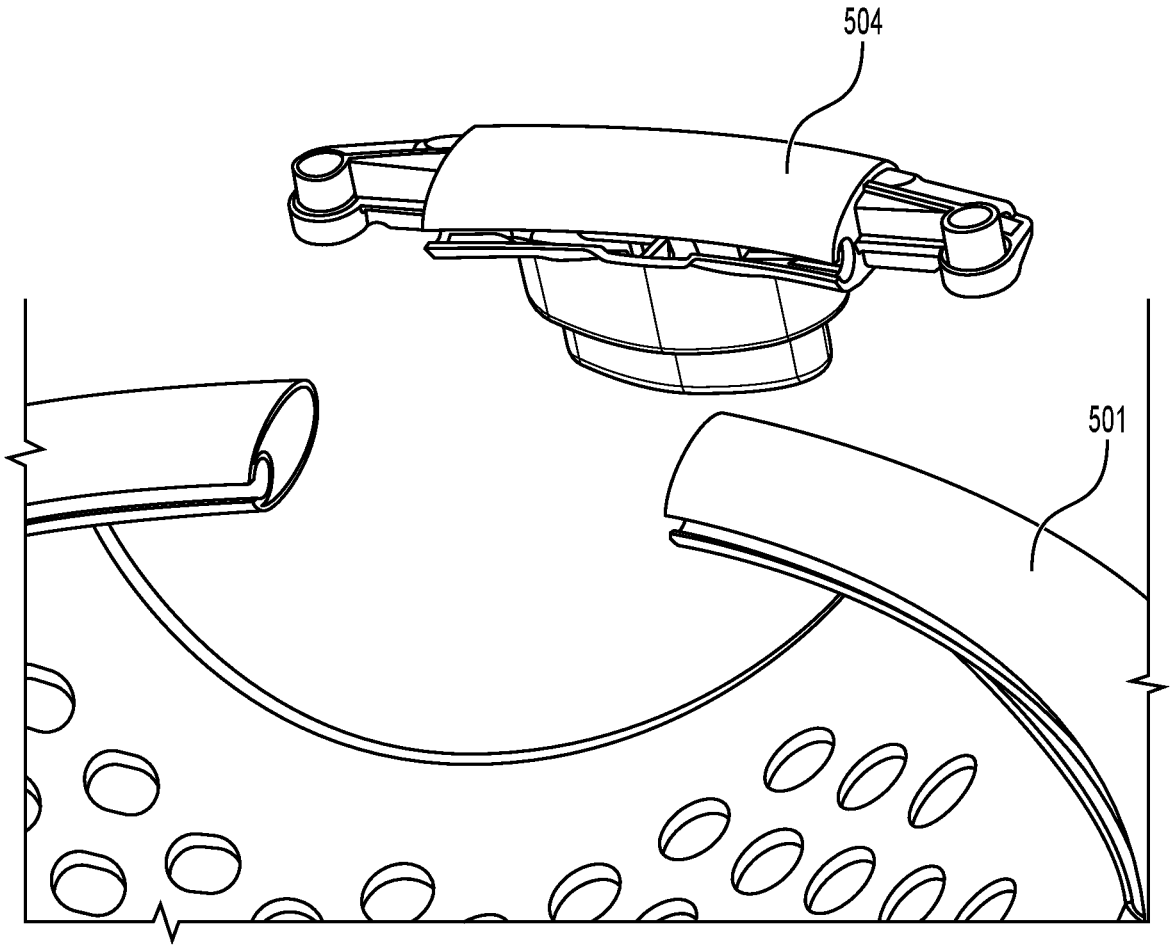
FIG. 23B illustrates an actuator connector of the seat of the child swing shown in FIG. 19.
Figure 24:
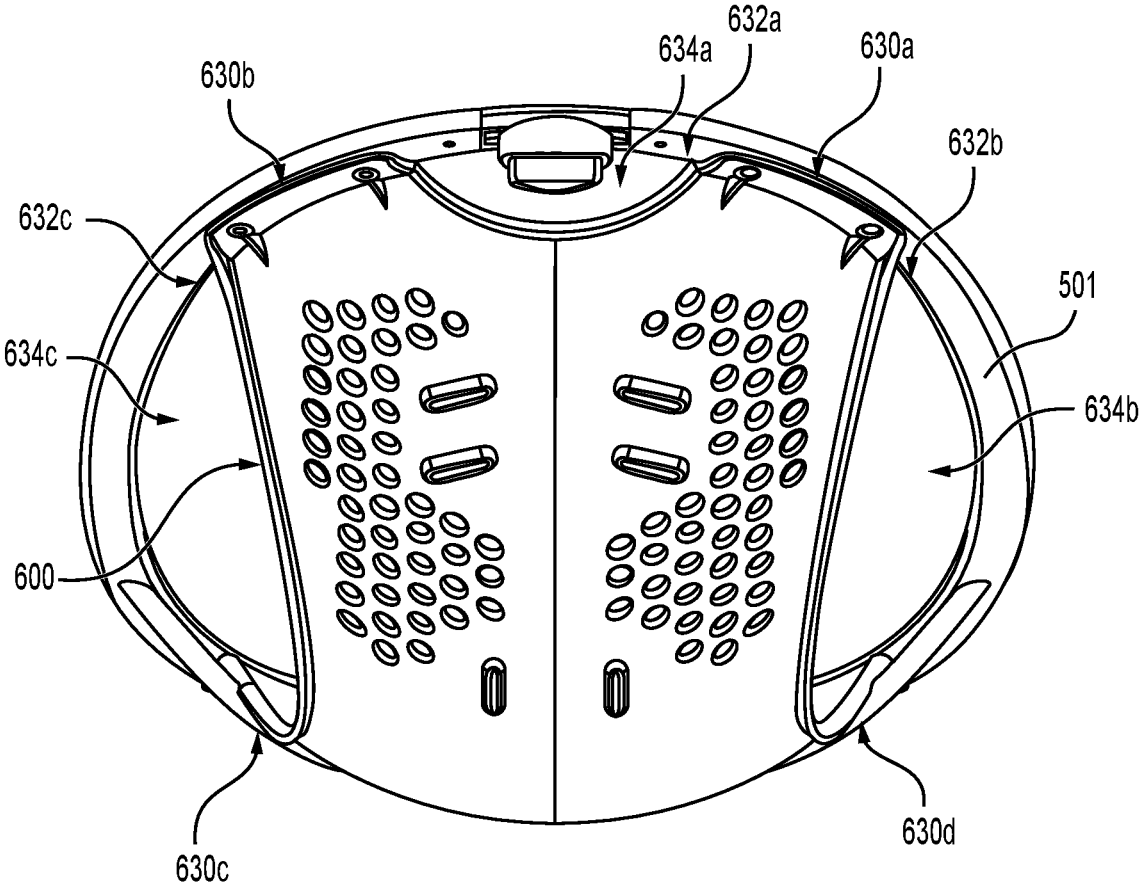
FIG. 24 illustrates a bottom perspective view of the seat of the child swing shown in FIG. 19.

FIG. 23A illustrates an exploded view of a seat 500 of the child swing 3; FIG. 24 illustrates a bottom perspective view of the seat 500 of the child swing 3. As shown in FIG. 24A, a contact portion 630 between the seat rim 501 and the seat support 600, including contact portions 630*a*, 630*b* located toward the upper end 510 and contact portions 630*c*, 630*d* at the lower end 512 (partially occluded in FIG. 24 and referenced in FIG. 23A), includes break 632*a* (located adjacent to the upper end 510 of the seat 500 between contact portions 630*a* and 630*b*), break 632*b* (located adjacent to one side (e.g., a first side) of the seat 500 between contact portions 630*b* and 630*c*), break 632*c* (located adjacent to the other side (e.g., a second side) of the seat 500 between contact portions 630*a* and 630*d*) and break 632*d* (located adjacent to the lower end 512 of the seat 500 between contact portions 630*c* and 630*d*) (occluded in FIG. 24 and referenced in FIG. 23A). The breaks 632*a*, 632*b*, 632*c*, and 632*d* are defined by locations along an edge of the seat support 600 that is not in contact with the seat rim 501 and are adjacent to contact portions 630*a* and 630*b* between the seat support 600 and the seat rim 501 along the length of the seat rim 501.

Figure 25:
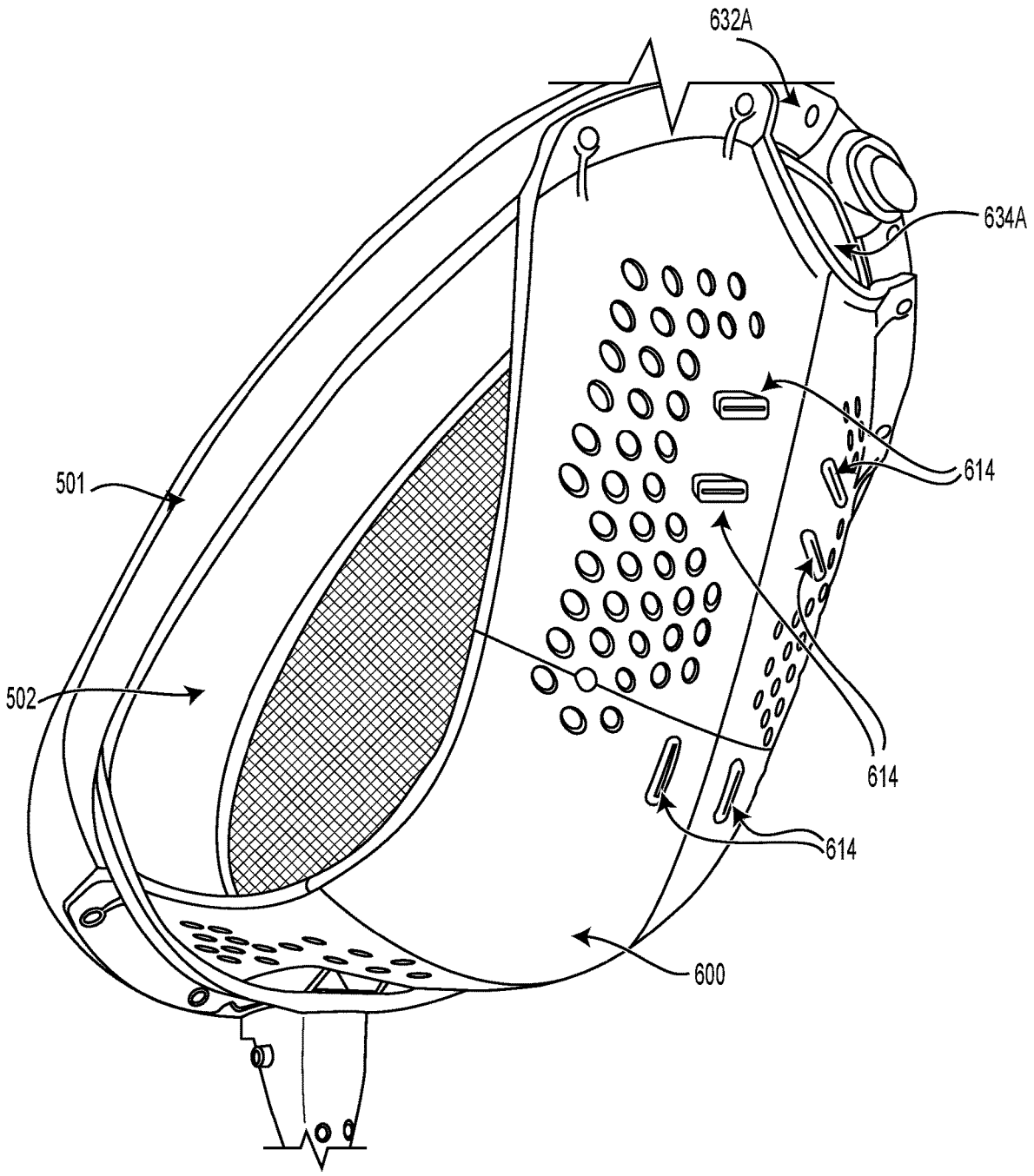
FIG. 25 illustrates a bottom perspective view of the child swing shown in FIG. 19.

Adjacent to the breaks 632, the seat support 600 can be shaped so that gaps 634 are formed between the seat rim 501 and the seat support 600. The breaks 632*a*, 632*b*, and 632*c* and associated gaps 634*a*, 634*b* and 634*c* can be positioned between the seat rim 501 and the seat support 600 at locations to provide, for example, easier gripping and carrying the child seat 3, space for features to be positioned along the seat rim 501 or along the edge of the seat support 600 (e.g., an actuator or other features as shown in FIG. 25), or for other reasons. It will be appreciated that the contact portion 630 can extend between the seat rim 501 and the seat support 600 about a substantial entirety of the seat rim 501 such that there are no breaks in contact between the seat rim 501 and the seat support 600 about the edge of the seat support 600. Alternatively, as shown above, there can be one or more breaks about between the seat rim 501 and the seat support 600.

Figure 26:
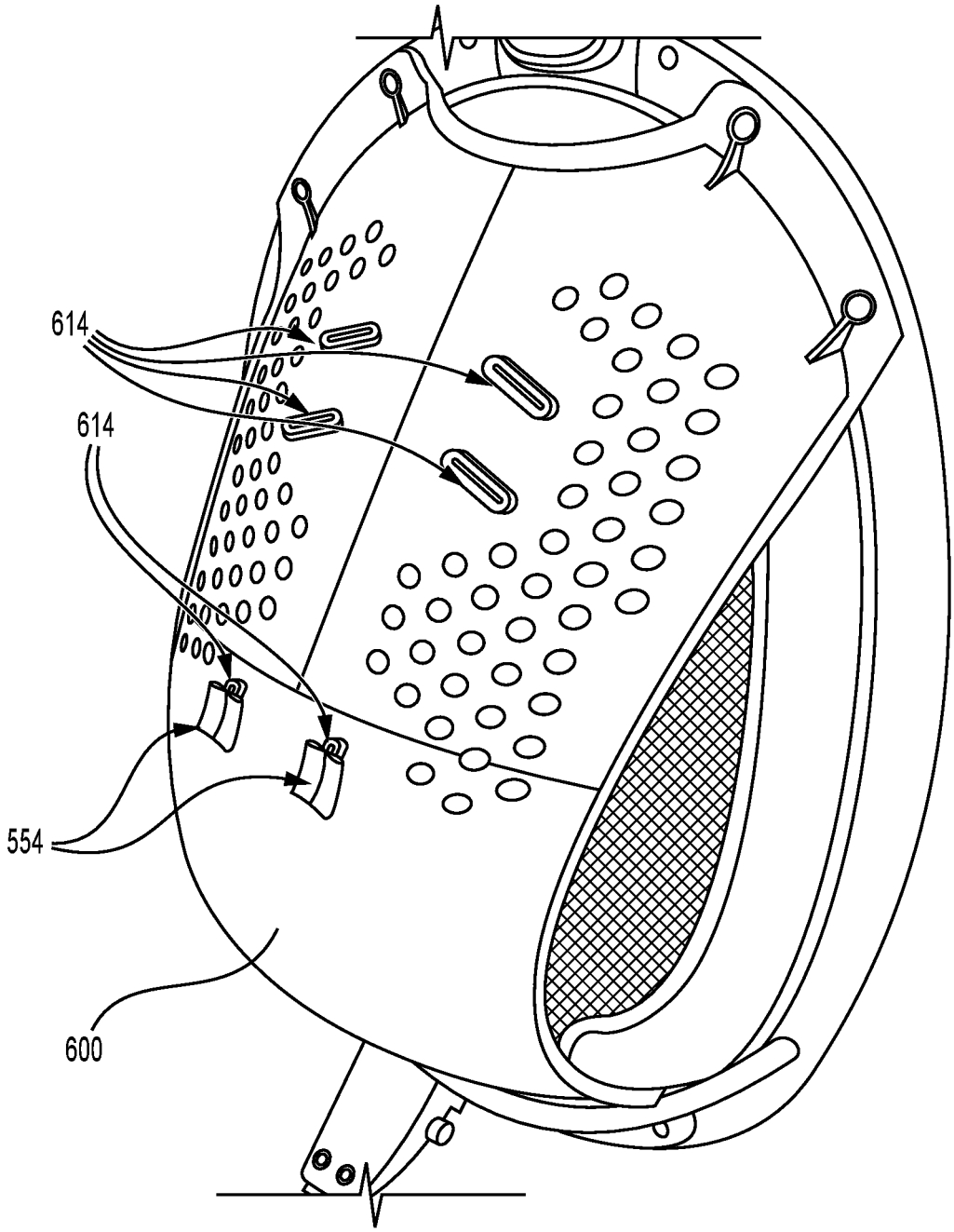
FIG. 26 illustrates a bottom perspective view of the child swing shown in FIG. 19.
Figure 27:
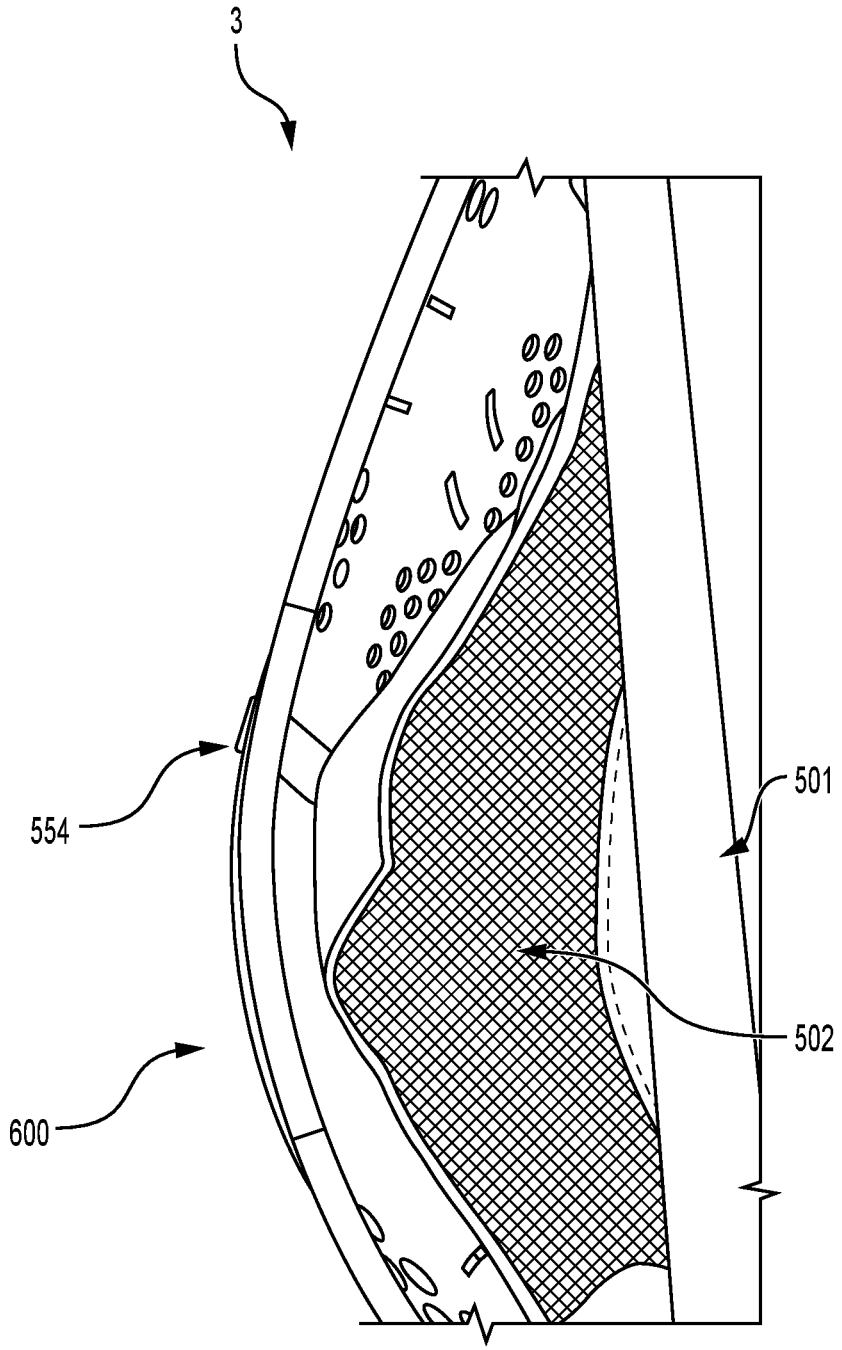
FIG. 27 illustrates a side view of a portion of the child swing shown in FIG. 19.

FIGS. 25-27 show the seat support 600 of the child swing 3 including restraint holes 614 for restraint straps 552 extending through the seat support 600. FIG. 25 illustrates a bottom perspective view of a portion of the child swing 3; FIG. 26 illustrates a bottom perspective view of a portion of the child swing 3; FIG. 27 illustrates a side view of a portion of the child swing 3. The seat support 600 can include at least one restraint hole 614 (e.g., an anchor point) that extends through the seat support 600, as shown in FIG. 21. The restraint holes 614 can be configured to receive, for example, the restraint straps 552 therethrough. When a seating surface 502 (e.g., soft goods for seating as described above with regard to the seating surface 102 of FIG. 1) is attached to the seat rim 501, the restraint straps 552 can also be inserted through holes (not labelled) in the seating surface 502.

When a child is positioned on the seat support 600, the restraint straps 552 can be fastened around the child to retain the child within the seat 500. A restraint assembly may comprise a harness comprising multiple restraint straps 552 anchored to the seat support 600 via multiple restraint holes 614, as will be described in greater detail below with regard to FIGS. 28-32. It will be appreciated that use of the restraint holes 614 to receive the restraint straps 552 can be optional. For example, the restraint straps 552 can be inserted through holes (not labelled in FIGS. 25-27) in the seating surface 502 and not through the restraint holes 614 to retain the child within the child swing 3. In an aspect, the seat support 600 does not include restraint holes 614, and the child is retained within the child swing via the restraint straps 552 inserted through the seating surface 502.

As shown in FIGS. 26-27, the restraint holes 614 can also receive webbing straps 554 within. The webbing straps 554 can secure the seating surface 502 to the seat support 600. The webbing straps 554 can be attached to the seat support 600 by, e.g., a double-butterfly stitch. In some examples, one or more of the restraint holes 614 can receive both a restraint strap 552 and a webbing strap 554 within.

FIGS. 28-32 illustrate a further aspect of a child swing comprising a harness assembly 550, according to aspects of this disclosure. The harness assembly 550 is described with regard to the child swing 3 of FIGS. 19-27. However, it should be understood that the harness assembly 550 can be implemented in other types of child swing, including the child swing 1 and the child swing 2 described above, and the present embodiments are not limited to the child swings 1, 2 or 3. Additionally, the child swing of FIGS. 28-32 can be transitioned between a first mode, e.g., a mode suitable for holding an infant, and a second mode, e.g., a mode suitable for holding a child larger than an infant. Similar to the harness assembly 550, the first and second modes are described with regard to the child swing 3 of FIGS. 19-27. However, it should be understood that the functionality described for the first and second modes can be implemented in any of the child swings 1, 2 or 3 or other types of child swings.

Figure 28A:
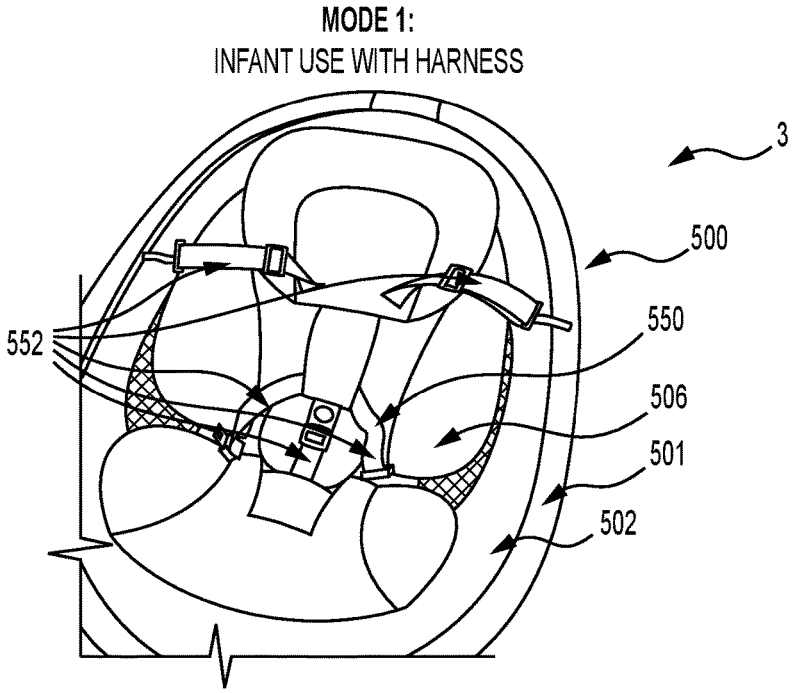
FIG. 28A illustrates a child swing in an infant mode, according to an aspect of this disclosure.

FIG. 28A illustrates the child swing 3 in a first mode (e.g., an infant mode) with a harness assembly 550 (e.g., a restraint assembly) and infant padding 506. The infant padding 506 can comprise soft goods with cushioning for receiving a child, e.g., an infant child. The infant padding 506 is sized and shaped for supporting children within certain size ranges, as would be understood by those skilled in the art. The infant padding 506 can be positioned on top of the seating surface 502 (e.g., soft goods) connected to the seat rim 501. The seating surface 502 is positioned on top of the seat support 600.

Figure 29A:
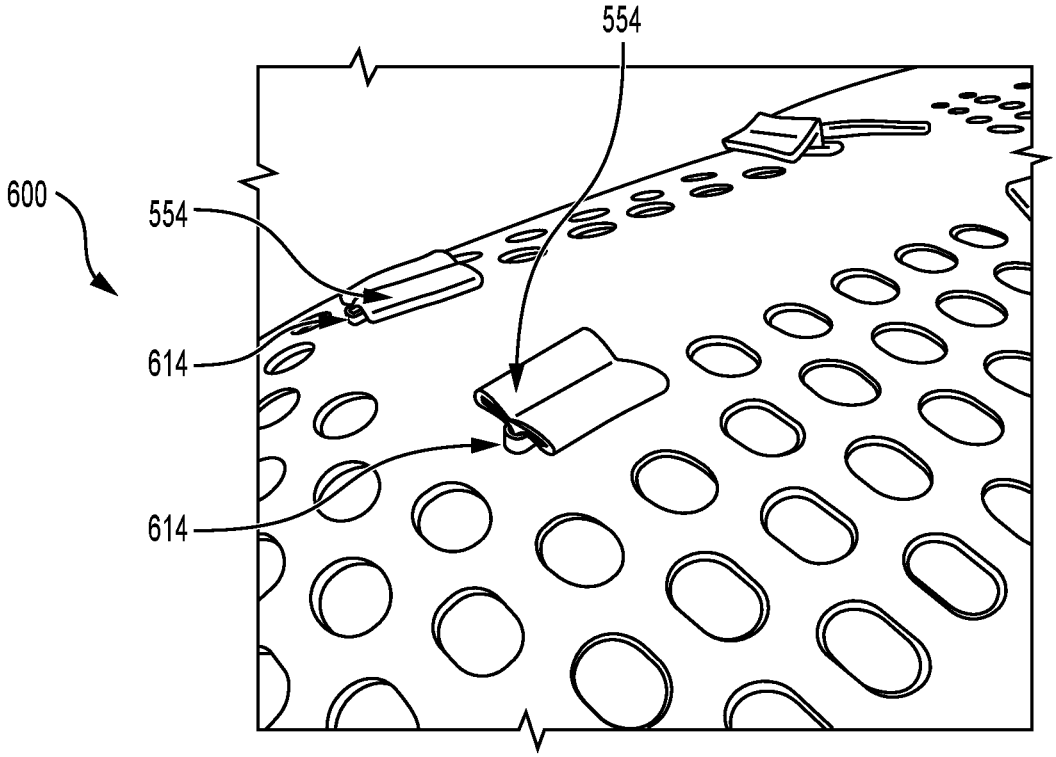
FIGS. 29A and 29B illustrate a connection between a restraint assembly and a child seat, according to an aspect of this disclosure.
Figure 29B:
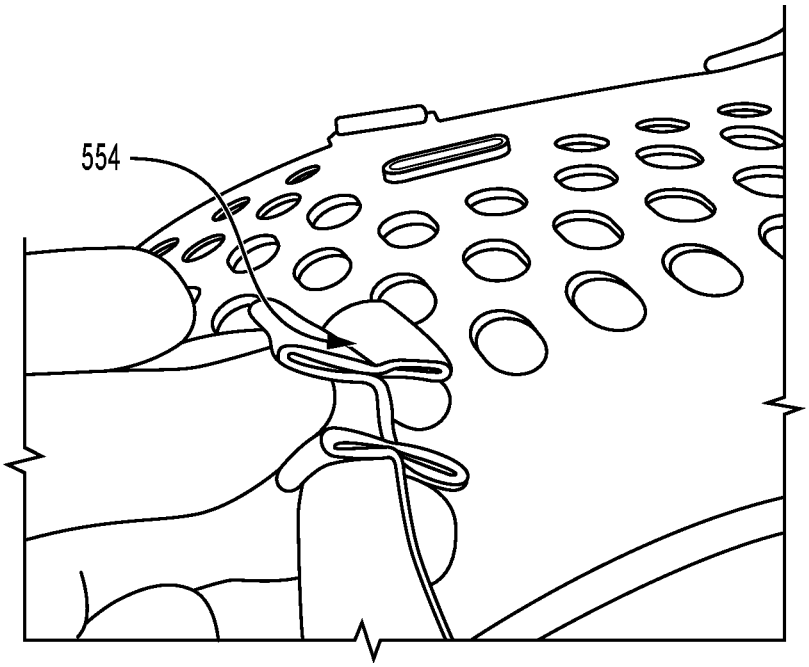

FIGS. 29A and 29B illustrate a connection between the harness assembly 550 and the seat support 600, according to an aspect of this disclosure. The harness assembly 550 comprises a number of restraint straps 552, e.g., five restraint straps 552, attached to the seat support 600 at different locations around the seat support 600. In this aspect, the restraint straps 552 are attached to the seat support 600 with a double-butterfly stitch to substantially prevent the restraint straps 552 from pulling through the seat support 600 and from dangling below the seat 500. It will be appreciated that other attachment methods and/or structures can be used to attach the harness assembly 550 to the seat 500.

Figure 28B:
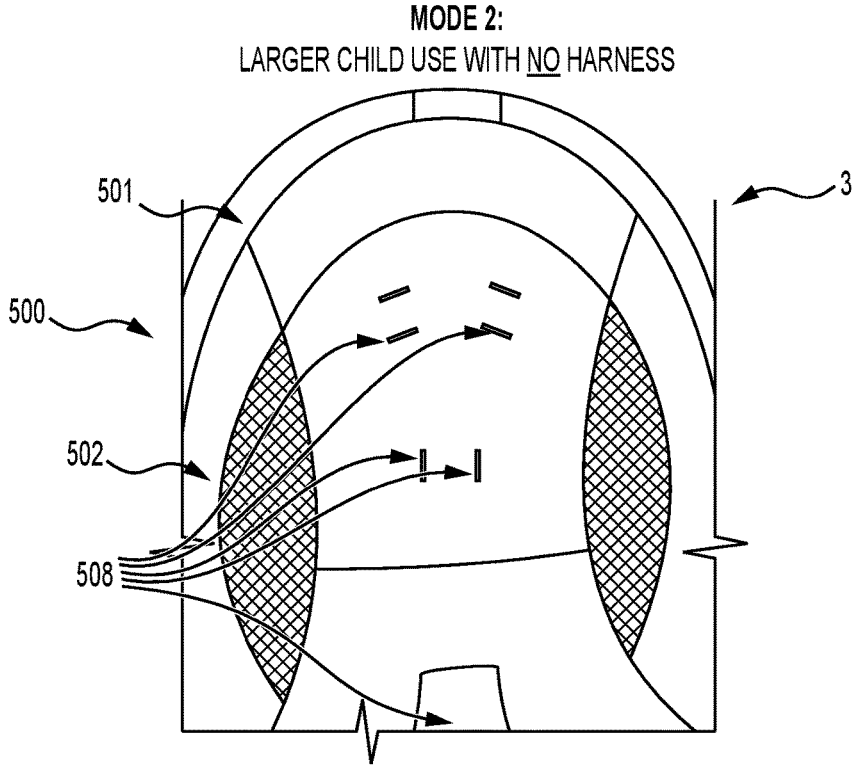
FIG. 28B illustrates a child swing in child mode, according to an aspect of this disclosure.

The seating surface 502 comprises restraint holes 508 for the receiving the restraint straps 552 extending from the seat support 600, as shown in FIG. 28B. In this example, the infant padding 506 also includes restraint holes (not labeled). The loose ends of the restraint straps 552, as shown in FIG. 28A, extending from the seat support 600 through the seating surface 502 and the infant padding 506 can be connected (e.g., the harness assembly 500 is buckled together). In the first mode, the harness assembly 500 can be buckled together around an infant child placed in the seat 500.

FIG. 28B illustrates the child swing 3 in a second mode (e.g., a child mode), with the harness assembly 550 below the seating surface 602 and with the infant padding 506 removed. The harness assembly 550 can remain attached to the seat support 600 in both the first and second modes. To remove the infant padding 506, the restraint straps 552 can be pulled through the restraint holes of the infant padding 506 and the infant padding 506 can be lifted off the seating surface 502.

Figure 30:
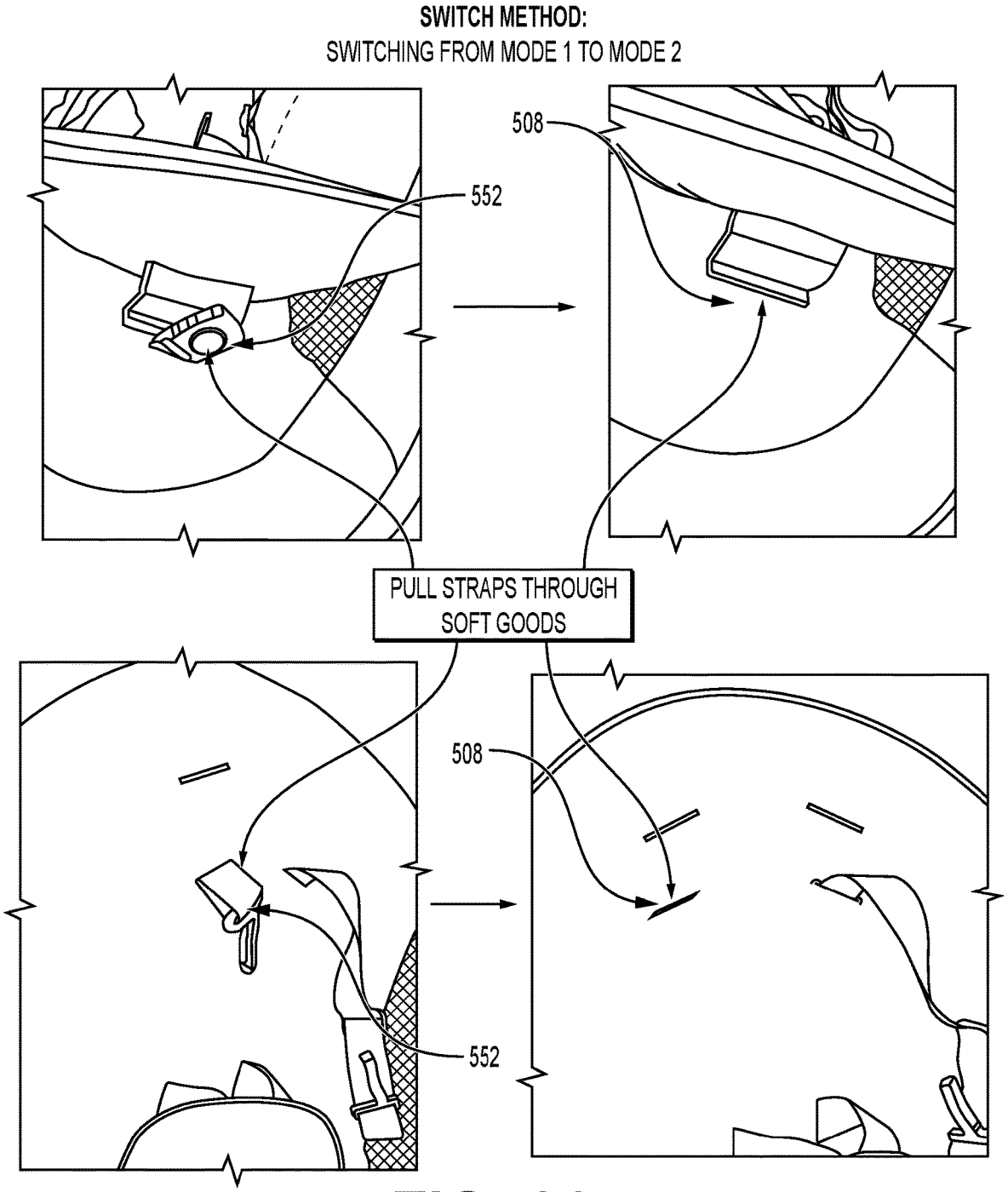
FIGS. 30 and 31 illustrate a method of removing a restraint assembly from soft goods, according to an aspect of this disclosure.
Figure 31:
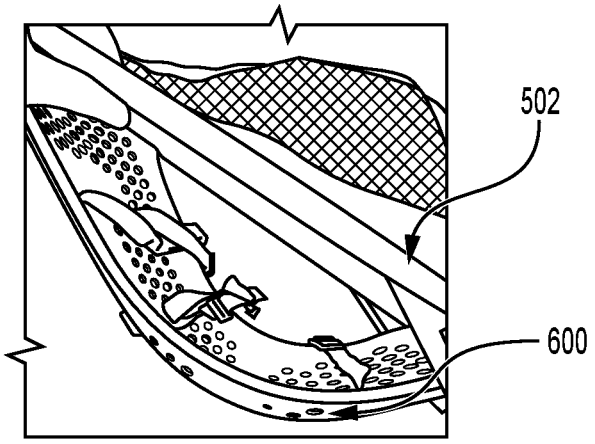
Figure 31:
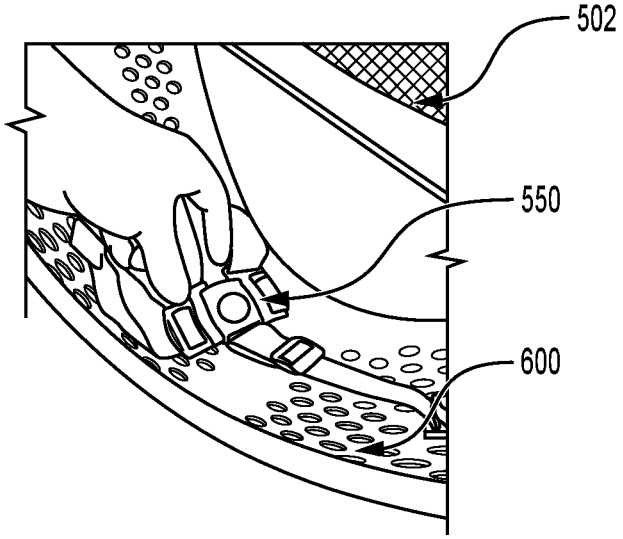
Figure 31:
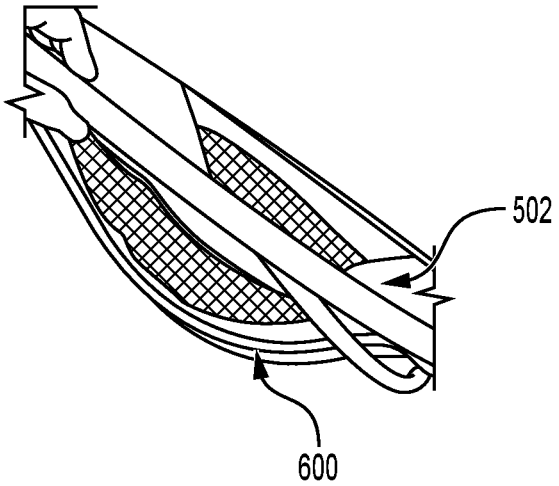

FIG. 30 illustrates the removal of the harness assembly 550 from the seating surface 502 that is attached to the seat rim 501. Each of the restraint strap 552 of the harness assembly 550 can be pulled through the restraint holes 508 in the seating surface 502. FIG. 31 illustrates the harness assembly 550 stored underneath the seating surface 502 on top of the seat support 600. The harness assembly 550 can be buckled together underneath the soft goods to prevent dangling. The soft goods can be pressed down onto the seat 500 to cover the harness assembly 550.

Figure 32:
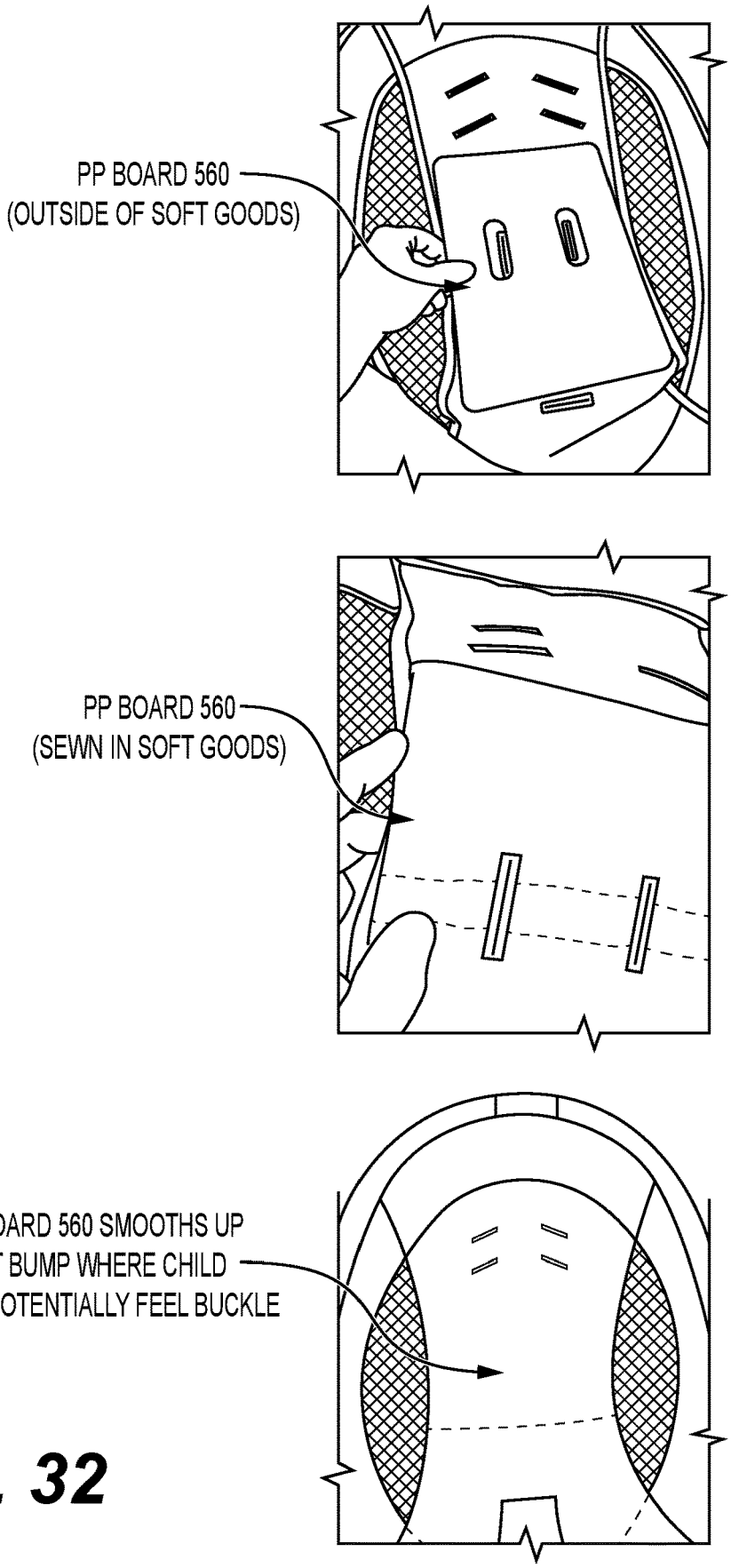
FIG. 32 illustrates a child seat having soft goods with a support board, according to an aspect of this disclosure.

FIG. 32 illustrates a board 560 (e.g., polypropylene (PP) board) positioned within the seating surface 602. The board 560 can be sewn into the soft goods to cover the harness assembly 550 to create a smooth surface for supporting a child. It will be appreciated that the board 560 can be positioned above or below the soft goods to create a smooth surface for supporting the child.

Unless explicitly stated otherwise, each numerical value and range should be interpreted as being approximate as if the word "about," "approximately," or "substantially" preceded the value or range. The terms "about," "approximately," and "substantially" can be understood as describing a range that is within 15 percent of a specified value unless otherwise stated.

Conditional language used herein, such as, among others, "can", "could", "might", "may", "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without author input or prompting, whether these features, elements and/or steps are included or are to be performed in any particular embodiment. The terms "comprising", "including", "having," and the like are synonymous and are used inclusively, in an open-ended fashion, and do not exclude additional elements, features, acts, operations, and so forth.

While certain example embodiments have been described, these embodiments have been presented by way of example only and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

The indefinite articles "a" and "an," as used herein in the specification and in the claims, unless clearly indicated to the contrary, should be understood to mean "at least one." Thus, it will be understood that reference herein to "a," "and," or "one" to describe a feature such as a component or step does not foreclose additional features or multiples of the feature. For instance, reference to a device having, comprising, including, or defining "one" of a feature does not preclude the device from having, comprising, including, or defining more than one of the feature, as long as the device has, comprises, includes, or defines at least one of the feature. Similarly, reference herein to "one of" a plurality of features does not foreclose the invention from including two or more of the features. For instance, reference to a device having, comprising, including, or defining "one of a protrusion and a recess" does not foreclose the device from having both the protrusion and the recess.

The phrase "and/or," as used herein in the specification and in the claims, should be understood to mean "either or both" of the components so conjoined, i.e., components that are conjunctively present in some cases and disjunctively present in other cases. Multiple components listed with "and/or" should be construed in the same fashion, i.e., "one or more" of the components so conjoined. Other components may optionally be present other than the components specifically identified by the "and/or" clause, whether related or unrelated to those components specifically identified. Thus, as a non-limiting example, a reference to "A and/or B", when used in conjunction with open-ended language such as "comprising" can refer, in one embodiment, to A only (optionally including components other than B); in another embodiment, to B only (optionally including components other than A); in yet another embodiment, to both A and B (optionally including other components); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of components, and, optionally, additional unlisted items. Only terms clearly indicated to the contrary, such as "only one of" or "exactly one of," or, when used in the claims, "consisting of," will refer to the inclusion of exactly one component of a number or list of components. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more components, should be understood to mean at least one component selected from any one or more of the components in the list of components, but not necessarily including at least one of each and every component specifically listed within the list of components and not excluding any combinations of components in the list of components. This definition also allows that components may optionally be present other than the components specifically identified within the list of components to which the phrase "at least one" refers, whether related or unrelated to those components specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including components other than B); in another embodiment, to at least one, optionally including more than one, B, with no A present (and optionally including components other than A); in yet another embodiment, to at least one, optionally including more than one, A, and at least one, optionally including more than one, B (and optionally including other components); etc.

The words "inward," "outward," "upper," and "lower" refer to directions toward or away from, respectively, the geometric center of the component.

What is claimed:

1. A seat for a child swing, the child swing including a base and a column extending from the base, the base being positionable on a floor, the seat comprising:

a seat rim connectable to the column to support the seat above the floor so that the seat can move relative to the base in a swinging motion, the seat rim defining a seat opening; and a seat support comprising a rigid material and being attached to the seat rim such that movement between the seat support and the seat rim is substantially prevented, the seat support defining a recess on one side of the seat opening, wherein the seat support is positioned relative to the seat rim such that when a child is introduced through the seat opening from an opposing side of the seat opening, the seat support supports the child within the recess, wherein the seat opening extends along a seat rim plane, wherein when the seat is viewed in a direction substantially perpendicular to the seat rim plane, an area of the seat support is less than 50% of an area of the seat opening.

2. The seat of claim 1, wherein the seat rim comprises a first material that extends about the seat opening, wherein the first material and the rigid material are different.

3. The seat of claim 2, wherein the first material comprises a metal.

4. The seat of claim 2, wherein the rigid material comprises a plastic.

5. The seat of claim 1, wherein the seat support is attached to the seat rim via at least one fastener.

6. The seat of claim 1, wherein the seat support contacts the seat rim along a portion of a length of the seat rim.

7. The seat of claim 6, wherein the portion of the length of the seat support contacting the seat rim is less than half of the length of the seat rim.

8. The seat of claim 1, wherein the seat support contacts the seat rim at multiple contact locations and forms breaks between the contact locations.

9. The seat of claim 8, further comprising:

an actuator connected to the seat rim and located in a break between the contact locations with the seat support, wherein the actuator and the seat rim form a perimeter of the seat, wherein the actuator is configured to adjust an incline of the seat relative to the base.

10. The seat of claim 1, wherein the area of the seat support is less than 30% of the area of the seat opening.

11. The seat of claim 1, wherein the seat support defines at least one restraint hole therethrough that connects the recess to an exterior of the seat.

12. The seat of claim 1, further comprising:

a seating surface supported by the seat rim within the recess of the seat support, the seating surface comprising soft goods.

13. The seat of claim 12, further comprising:

a child restraint assembly attached to the seat support, wherein the child restraint assembly includes at least one restraint strap positioned through at least one restraint hole to attach the at least one restraint strap to the seat support and to retain the child within the seat when a child is supported on the seat support.

14. The seat of claim 13, wherein the seat is transitionable between a first mode suitable for an infant and a second mode suitable for a child larger than the infant.

15. The seat of claim 14, wherein the first mode comprises the at least one restraint strap extending through the seating surface via at least one restraint hole so that the child restraint assembly can retain the child within the seat and the second mode comprises the at least one restraint strap withdrawn through the seating surface and positioned beneath the seating surface.

16. The seat of claim 15, wherein transitioning the seat from the first mode to the second mode includes lifting the seating surface, moving the child restraint assembly between the seat support and the seating surface, buckling the child restraint assembly, and lowering the seating surface.

17. The seat of claim 15, wherein the seating surface comprises a polypropylene board positioned within or adjacent to the seating surface for covering the child restraint assembly when the seat is in the second mode.

18. The seat of claim 14, wherein, in the first mode, at least a portion of the soft goods comprises infant padding positioned above the seating surface, the infant padding comprising at least one further restraint hole configured to receive the at least one restraint strap.

19. The seat of claim 1, wherein the seat support defines at least one vent hole therethrough that connects the recess to an exterior of the seat.

20. A seat for a child swing, the child swing including a base and a column extending from the base, the base being positionable on a floor, the seat comprising:

a seat rim connectable to the column to support the seat above the floor, the seat rim defining a seat opening;

a seat support comprising a rigid material and being attached to the seat rim such that movement between the seat support and the seat rim is substantially prevented, the seat support defining a recess on one side of the seat opening, wherein the seat support is positioned relative to the seat rim such that when a child is introduced through the seat opening from an opposing side of the seat opening, the seat support supports the child within the recess, wherein the seat support contacts the seat rim at multiple contact locations and forms breaks between the contact locations; and an actuator connected to the seat rim and located in a break between the contact locations with the seat support, wherein the actuator and the seat rim form a perimeter of the seat, and wherein the actuator is configured to adjust an incline of the seat relative to the base.

21. A seat for a child swing, the child swing including a base and a column extending from the base, the base being positionable on a floor, the seat comprising:

a seat rim connectable to the column to support the seat above the floor, the seat rim defining a seat opening;

a seat support comprising a rigid material and being attached to the seat rim such that movement between the seat support and the seat rim is substantially prevented, the seat support defining a recess on one side of the seat opening, wherein the seat support is positioned relative to the seat rim such that when a child is introduced through the seat opening from an opposing side of the seat opening, the seat support supports the child within the recess;

a seating surface supported by the seat rim within the recess of the seat support, the seating surface comprising soft goods; and a child restraint assembly attached to the seat support, wherein the child restraint assembly includes at least one restraint strap positioned through at least one restraint hole to attach the at least one restraint strap to the seat support and to retain the child within the seat when a child is supported on the seat support, wherein the seat is transitionable between a first mode suitable for an infant and a second mode suitable for a child larger than the infant and wherein the first mode comprises the at least one restraint strap extending through the seating surface via at least one restraint hole so that the child restraint assembly can retain the child within the seat and the second mode comprises the at least one restraint strap withdrawn through the seating surface and positioned beneath the seating surface.

* * * * *